US007120381B2

(12) United States Patent
Matsuoka

(10) Patent No.: US 7,120,381 B2
(45) Date of Patent: Oct. 10, 2006

(54) IMAGE-FORMING MACHINE

(75) Inventor: Keiji Matsuoka, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 190 days.

(21) Appl. No.: 10/855,993

(22) Filed: May 28, 2004

(65) Prior Publication Data

US 2005/0036811 A1 Feb. 17, 2005

(30) Foreign Application Priority Data

May 29, 2003 (JP) ..... 2003-152369

(51) Int. Cl.
*G03G 15/00* (2006.01)

(52) U.S. Cl. ..... 399/385; 399/384; 400/606; 400/607; 400/621

(58) Field of Classification Search ..... 399/384, 399/385, 387, 400; 400/605, 606, 607, 609, 400/621

See application file for complete search history.

(56) References Cited

U.S. PATENT DOCUMENTS 5,237,378 A * 8/1993 McEwen ..... 399/21
5,701,573 A * 12/1997 Yoshiuchi et al. ..... 399/384
6,042,228 A * 3/2000 Yamada et al. ..... 347/104

FOREIGN PATENT DOCUMENTS

JP 9-43917 2/1997

* cited by examiner

*Primary Examiner*—Ren Yan
(74) *Attorney, Agent, or Firm*—Smith, Gambrell & Russell, LLP

(57) ABSTRACT

A copier comprising rolled paper accommodation units in which the rolled papers are installed, paper feed rollers and paper conveying rollers for conveying the papers delivered from the rolled papers along a paper conveying passage, a cutter and an image-forming means. A plurality of conveyance reference positions are set in the transfer region in a direction of conveying width so as to be corresponded to the sizes in the direction of conveying width of the papers passing through the transfer region of the image-forming means. The rolled papers are installed in the rolled paper accommodation units correspondingly to the conveyance reference positions.

8 Claims, 12 Drawing Sheets

IMAGE-FORMING MACHINE

FIELD OF THE INVENTION

The present invention relates to an image-forming machine such as an electrostatic copying machine, a printer or a facsimile capable of forming images on papers of large sizes, such as papers of JIS A0-size and A1-size.

DESCRIPTION OF THE RELATED ART

It has been desired that the image-forming machines capable of forming images on papers of large sizes are so constituted as to also form images, i.e., to copy or print images even on papers of A2- to A4-sizes in addition to papers of large sizes such as JIS A0- and A1-sizes. In order to satisfy the requirement of copying or printing images onto the papers of such multiplicity of sizes, it is a generally accepted practice to provide a plurality of rolled paper units comprising roll bodies and rolled papers wound on the roll bodies depending upon the widths of the papers and install them in the body of an image-forming machine in the up-and-down direction in a manner to be freely removed (e.g., see Japanese Unexamined Patent Publication (Kokai) No. 09-043917).

In the above image-forming machine, a toner image is transferred onto the paper delivered from the rolled paper as it passes through a transfer region of the image-forming means or, further concretely speaking, as it passes through a transfer region of a photosensitive material drum. The toner image is fixed as the paper passes through a fixing device. Further, the paper delivered from the rolled paper is cut into a size in the direction in which it is conveyed so as to be corresponded to a predetermined size by a cutting means on the way the paper is conveyed through the paper conveying passage. The paper on which the toner image is fixed is discharged by a discharge roller into a pocket disposed in front of the image-forming machine. The positions for installing the rolled paper units equipped with rolled papers of various sizes are so defined in the direction of width, i.e., the positions for installing the rolled papers in the direction of width are so defined in the direction of width that a center of the rolled paper in the direction of width passes through the center of the width of the transfer region of the photosensitive material drum when the paper delivered from the rolled paper is conveyed. Therefore, the center of the paper in the direction of width passes through the center of the transfer region in the direction of width when the paper delivered from the rolled paper is conveyed and passes through the transfer region.

When the images are copied or printed onto small-size papers having widths smaller than the papers having a maximum width by using the above-mentioned conventional image-forming machine, however, the central portion of the transfer region of the photosensitive drum in the direction of width is excessively utilized, causing the image-forming characteristics to lose stability, shortening the life of the photosensitive material drum due to excess of fatigue in the central portion and, further, arousing such problems as low productivity and efficiency, without being capable of sorting the discharged papers depending upon the sizes. In order for the images to be copied or printed onto the papers of various sizes, further, it becomes necessary to frequently exchange the rolled papers requiring cumbersome exchanging operation and increased burden of work.

SUMMARY OF THE INVENTION

It is an object of the present invention to provide a novel image-forming machine which is capable of copying or printing images onto papers of various sizes, evenly utilizes nearly the whole transfer region of the photosensitive material drum in the direction of width to maintain stability in the image-forming characteristics and to lengthen the life of the photosensitive material drum.

Another object of the present invention is to provide a novel image-forming machine which is capable of copying or printing images onto papers of various sizes, improving productivity and efficiency.

A further object of the present invention is to provide a novel image-forming machine which is capable of copying or printing images onto papers of various sizes, and makes it possible to sort the discharged papers depending upon the sizes.

A still further object of the present invention is to provide a novel image-forming machine which is capable of copying or printing images onto papers of various sizes, decreases the frequency for exchanging the rolled papers, facilitates the exchanging operation and reduces the burden of work.

According to the present invention, there is provided an image-forming machine comprising a plurality of rolled paper accommodation units in which the rolled papers are installed, a conveying means for conveying the papers delivered from the rolled papers along a paper conveying passage, a cutting means for cutting the papers that are conveyed, and an image-forming means for transferring the image while the papers being conveyed pass through a transfer region, wherein a plurality of conveyance reference positions are set in a direction of conveying width in the transfer region so as to be corresponded to the sizes of the papers passing through the transfer region in the direction of the conveying width, and the rolled papers are installed in the rolled paper accommodation units correspondingly to the conveyance reference positions.

It is desired that said conveyance reference positions of the plurality of rolled papers having widths smaller than the rolled paper having the maximum width are set at a plurality of places, and among the rolled papers having smaller widths, the two rolled papers are arranged on the same axis and in parallel with each other.

It is desired that the positions for installing the two rolled papers having smaller widths are so specified that the papers delivered from said two rolled papers having smaller widths are not overlapped one upon the other when they pass through the transfer region.

It is desired that the conveyance reference positions comprise a first conveyance reference position which is a center line extending in a direction in which the paper is conveyed passing through a center of the transfer region in the direction of conveying width, a second conveyance reference position which is a straight line extending in the direction in which the paper is conveyed passing through midway in the direction of conveying width of one region of the two regions divided by said center line in the direction of conveying width, and a third conveyance reference position which is a straight line extending in the direction in which the paper is conveyed passing through midway in the direction of conveying width of the other region of the two regions divided by said center line in the direction of conveying width; and the rolled paper having the maximum width is installed in a rolled paper accommodation unit in a manner that the central position thereof in the direction of width is corresponded to the first conveyance reference position, and the two rolled papers having smaller widths are installed in a rolled paper accommodation unit in a manner that the central positions thereof in the direction of width are corresponded to the second and third conveyance reference positions, respectively.

It is desired that the two rolled papers having smaller widths can be fed in parallel with each other.

It is desired that the two rolled papers having smaller widths can be fed independently from each other.

It is desired that the rolled paper accommodation unit comprises an accommodation frame that is so mounted as can be drawn out from the machine body, first and second rolled paper units arranged in the accommodation frame on the same axis and in parallel with each other so as to rotate independently from each other, and a drive mechanism for driving the first and second rolled paper units; and when the accommodation frame is mounted on the machine body, the drive mechanism is drivingly coupled to a drive source which is arranged in the machine body to rotate forward and reverse, and the first and second rolled paper units are rotated independently from each other.

It is desired that the first rolled paper unit comprises a first roll body that is supported in the accommodation frame so as to freely rotate and has first driven gears attached to both ends thereof integrally therewith in the axial direction, and the first rolled paper wound on the first roll body; the second rolled paper unit comprises a second roll body that is supported in the accommodation frame so as to freely rotate and has second driven gears attached to both ends thereof integrally therewith in the axial direction, and the second rolled paper wound on the second roll body; the drive mechanism has a first drive shaft and a second drive shaft supported in the accommodation frame so as to freely rotate; the first drive shaft has a first input gear arranged thereon so as to freely rotate relative thereto, and has first drive gears arranged integrally therewith so as to be in mesh with the first driven gears via first intermediate gears; the second drive shaft has a second input gear arranged thereon so as to freely rotate relative thereto, and has second drive gears arranged integrally therewith so as to be in mesh with the second driven gears via second intermediate gears; a first electromagnetic clutch means is arranged between the first input gear and the first drive shaft; a second electromagnetic clutch means is arranged between the second input gear and the second drive shaft; a main input gear in mesh with the first and second input gears is supported in the accommodation frame so as to freely rotate; an output gear drivingly coupled to the drive source is arranged in the machine body; and the main input gear is brought into mesh with the output gear when the accommodation frame is mounted on the machine body.

It is desired that said conveyance reference positions of the plurality of rolled papers having widths smaller than the rolled paper having the maximum width, are set at a plurality of places, and among the rolled papers having smaller widths, the two rolled papers are arranged on the axes different from each other.

It is desired that the two rolled papers having smaller widths can be fed independently from each other.

It is desired that the positions for installing the two rolled papers having smaller widths are so specified that the papers delivered from said two rolled papers having smaller widths are not overlapped one upon the other when they pass through the transfer region.

It is desired that the conveyance reference positions comprise a first conveyance reference position which is a center line extending in a direction in which the paper is conveyed passing through a center of the transfer region in the direction of conveying width, a second conveyance reference position which is a straight line extending in the direction in which the paper is conveyed passing through midway in the direction of conveying width of one region of the two regions divided by said center line in the direction of conveying width, and a third conveyance reference position which is a straight line extending in the direction in which the paper is conveyed passing through midway in the direction of conveying width of the other region of the two regions divided by said center line in the direction of conveying width; and the rolled paper having the maximum width is installed in the rolled paper accommodation unit in a manner that the central position thereof in the direction of width is corresponded to the first conveyance reference position, and the two rolled papers having smaller widths are installed in the rolled paper accommodation unit in a manner that the central positions thereof in the direction of width are corresponded to the second and third conveyance reference positions, respectively.

It is desired that the conveyance reference positions comprise a first conveyance reference position which is a center line extending in a direction in which the paper is conveyed passing through a center of the transfer region in the direction of conveying width, a second conveyance reference position which is a center line extending in the direction in which the paper is conveyed passing through a center in the direction of conveying width of one region of the two regions divided by said center line in the direction of conveying width, and a third conveyance reference position which is a center line extending in the direction in which the paper is conveyed passing through a center in the direction of conveying width of the other region of the two regions divided by said center line in the direction of conveying width; and the rolled paper having the maximum width is installed in the rolled paper accommodation unit in a manner that the central position thereof in the direction of width is corresponded to the first conveyance reference position, and the two rolled papers having smaller widths are installed in the rolled paper accommodation unit in a manner that the central positions thereof in the direction of width are corresponded to the second and third conveyance reference positions, respectively.

DETAILED DESCRIPTION OF THE PREFERRED EMBODIMENTS

Preferred embodiments of an image-forming machine constituted according to the present invention will now be described in further detail with reference to the accompanying drawings.

Figure 1:
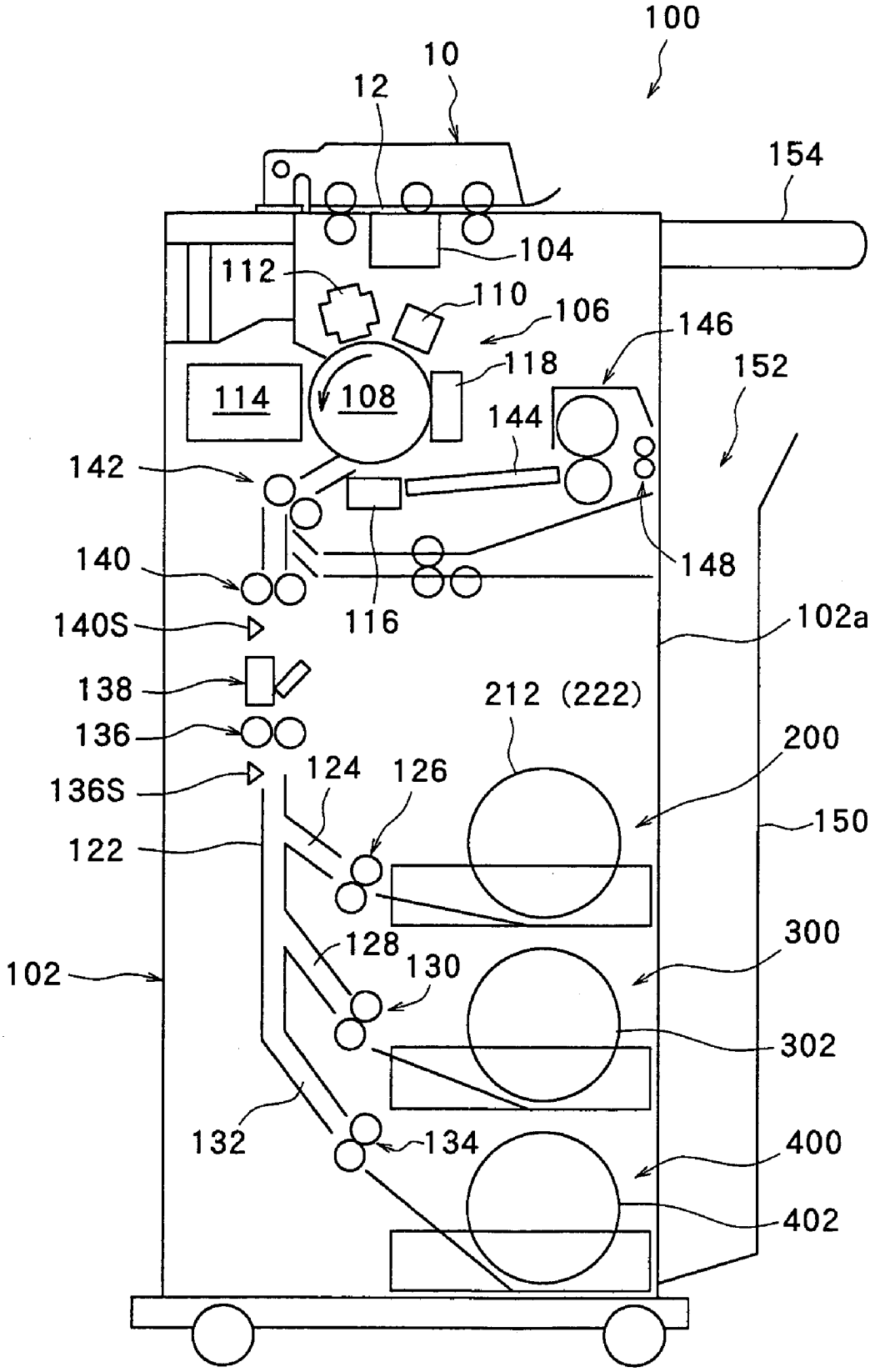
FIG. 1 is a sectional view schematically illustrating a preferred embodiment of a copier constituted according to the present invention.
Figure 2:
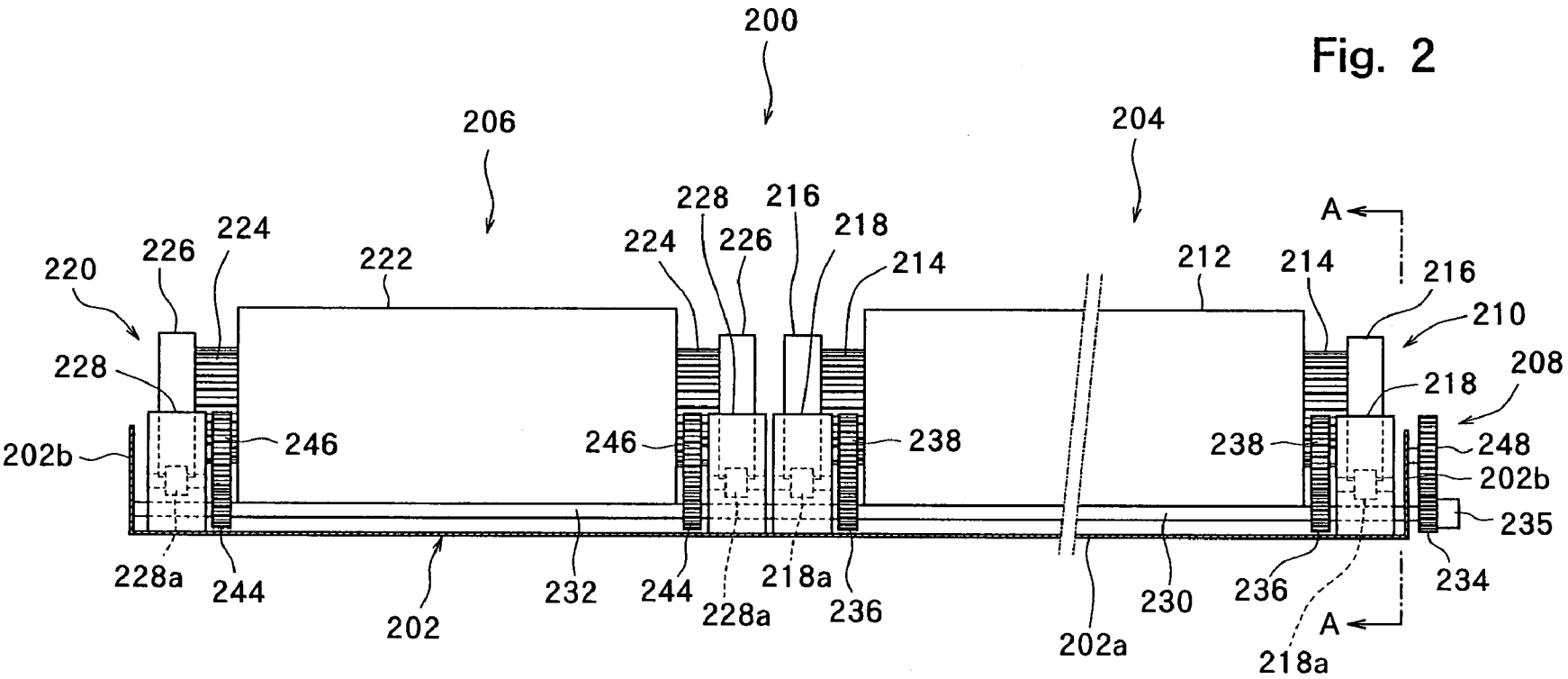
FIG. 2 is a rear view of when a roll accommodation unit mounted on the upper stage of the copier illustrated in FIG. 1 is viewed from the left in FIG. 1.
Figure 3:
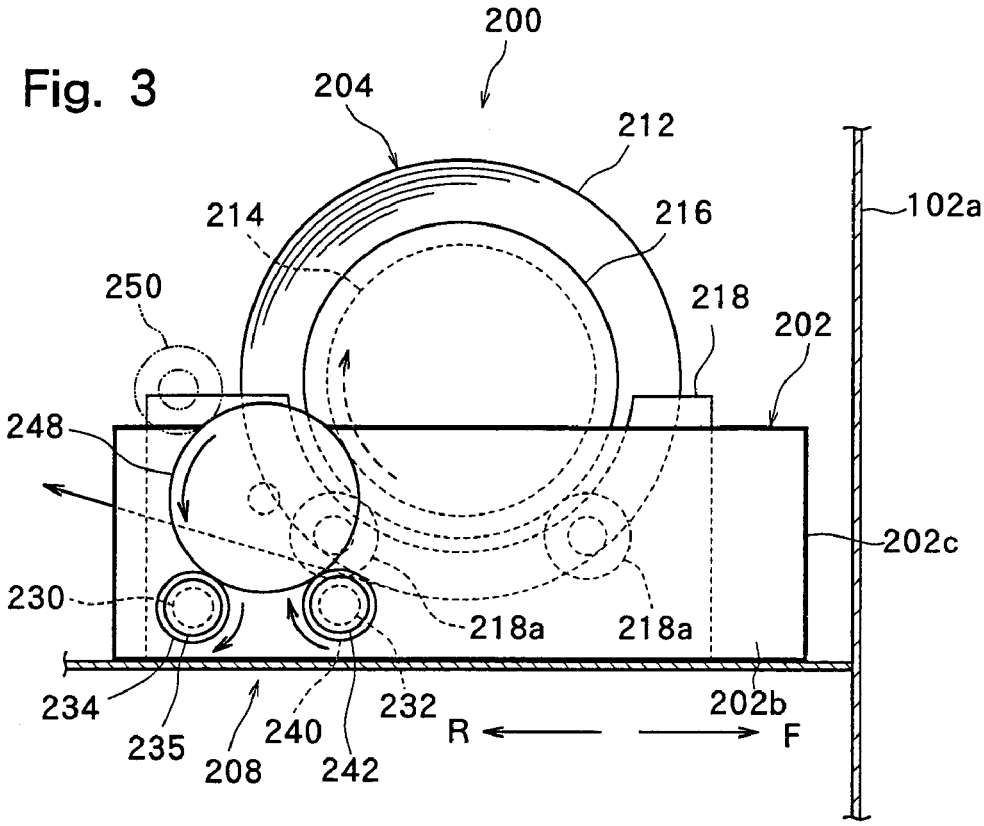
FIG. 3 is a side view of when the roll accommodation unit illustrated in FIG. 2 is viewed from the right in FIG. 2.
Figure 4:
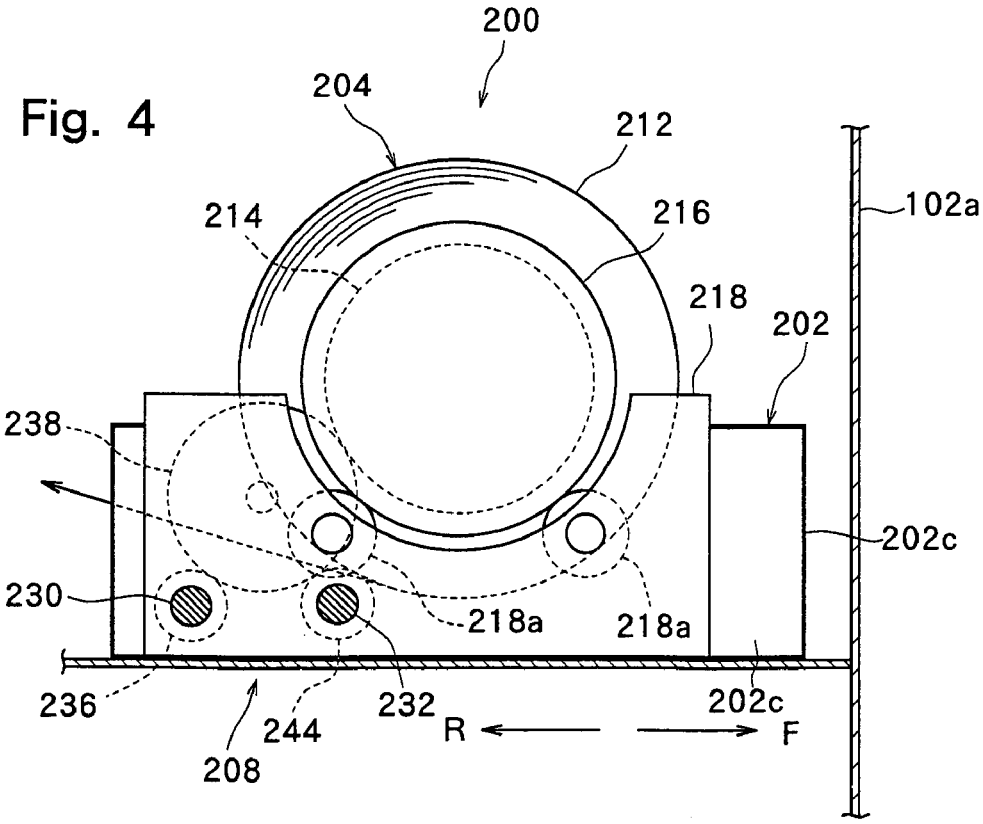
FIG. 4 is a sectional view along the arrows A—A in FIG. 2.

Referring to FIG. 1, an electrostatic copier generally designated at 100 has a copier body 102 of nearly a rectangular parallelepiped shape. A document conveying device 10 is provided at an upper end of the copier body 102. A closely contacted-type image sensor 104 is arranged at an upper end in the copier body 102 but right under the document conveying device 10. An image-forming means 106 is arranged under the closely contacted-type image sensor 104. The image-forming means 106 has a photosensitive material drum 108 which is rotated in the counter-clockwise direction in FIG. 1 by a drive means that is not shown.

The photosensitive material drum 108 is surrounded by a main charger 110 which homogeneously charges the surface of the photosensitive material drum 108, an LED print head 112 which projects the image of a document read by the closely contacted-type image sensor 104 onto the surface of the photosensitive material drum 108 to form an electrostatic latent image thereof, a developing device 114 for developing the electrostatic latent image formed on the surface of the photosensitive material drum 108 into a toner image, a transfer device 116 for transferring the toner image formed on the surface of the photosensitive material drum 108 onto a paper such as a common paper, and a cleaning device 118 for wiping and recovering the toner remaining on the surface of the photosensitive material drum 108. The image-forming means 106 is constituted by the photosensitive material drum 108 and by the above-mentioned devices arranged surrounding the photosensitive material drum 108.

At lower positions in the copier body 102, there are arranged rolled paper accommodation units 200; 300 and 400 that will be described later, and a paper conveying passage 122 for conveying the papers accommodated in the rolled paper accommodation units 200, 300 and 400 to a transfer region of the image-forming means 106. A paper feed passage 124 is arranged between the rolled paper accommodation unit 200 mounted on the upper stage in the copier body 102 and the paper conveying passage 122, and paper feed rollers 126 are arranged on the paper feed passage 124. A paper feed passage 128 is arranged between the rolled paper accommodation unit 300 mounted on the middle stage in the copier body 102 and the paper conveying passage 122, and paper feed rollers 130 are arranged on the paper feed passage 128. A paper feed passage 132 is arranged between the rolled paper accommodation unit 400 mounted on the lower stage in the copier body 102 and the paper conveying passage 122, and paper feed rollers 134 are arranged on the paper feed passage 132.

On and along the paper conveying passage 122, there are arranged paper conveying rollers 136, a cutter 138 which is a cutting means, resist rollers 140 and pre-transfer rollers 142 in order mentioned from the upstream toward the downstream. The above paper-feed rollers 126, 130 and 134, paper conveying rollers 136, resist rollers 140 and pre-transfer rollers 142 constitute a conveying means for conveying the papers delivered from the rolled papers that will be described later along the paper conveying passage 122. The cutter 138 is so constituted as to cut the paper that is conveyed in a direction at right angles with the direction of conveyance. Here, the cutter 138 may be constituted in a known manner. A paper detector means for detecting the paper that is conveyed or, in this embodiment, a paper sensor (pre-conveyance) 136S is arranged on the upstream side of the paper conveying rollers 136 on the paper conveying passage 122. The paper detector means for detecting the paper that is conveyed or, in this embodiment, a paper sensor (pre-resist) 140S is arranged on the upstream side of the resist rollers 140 on the paper conveying passage 122.

Figure 8:
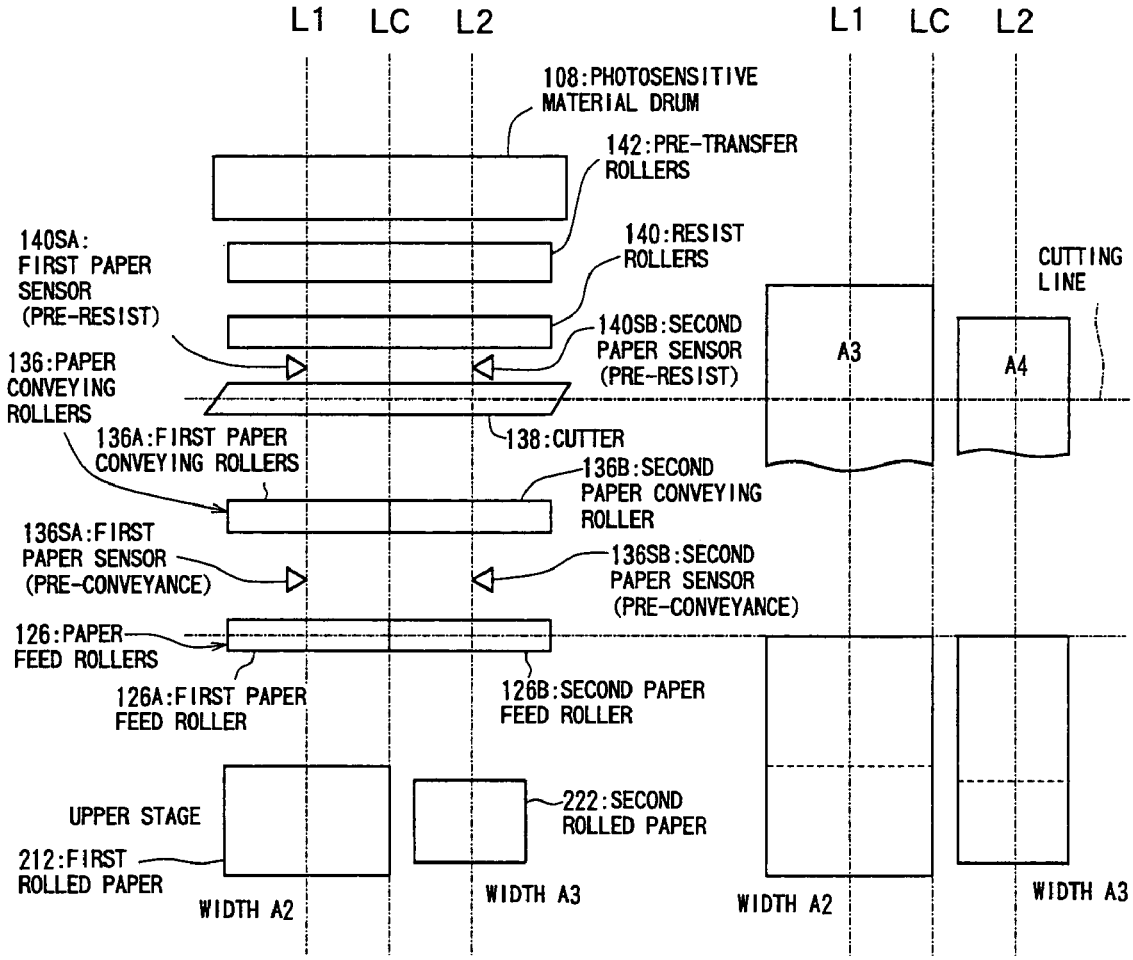
FIG. 8 is a diagram of arrangement schematically illustrating a relationship between the positions of papers delivered from the first and second rolled papers and the arrangement of rollers and cutters on the conveying passages from the first and second rolled papers in the roll accommodation units mounted on the upper stage of the copier illustrated in FIG. 1 to the photosensitive material drum.

Referring to FIG. 8, the paper sensor (pre-conveyance) 136S and the paper sensor (pre-resist) 140S have, respectively, a first paper sensor (pre-conveyance) 136SA and a first paper sensor (pre-resist) 140SA for detecting the paper conveyed along a conveyance reference position L1 that will be described later, and a second paper sensor (pre-conveyance) 136SB and a second paper sensor (pre-resist) 140SB for detecting the paper conveyed along a conveyance reference position L2. The paper conveyed along the conveyance reference position LC can be detected by either the first paper sensor (pre-conveyance) 136SA or the second paper sensor (pre-conveyance) 136SB, or by either the first paper sensor (pre-resist) 140SA or the second paper sensor (pre-resist) 140 SB. On the paper feed passages 124, 128 and 132, there are arranged a rolled paper detector means or, in this embodiment, rolled paper sensors though not shown. Like the paper sensors described above, the rolled paper sensors arranged in the paper feed passage 124 have first rolled paper sensors and second rolled paper sensors.

Figure 9:
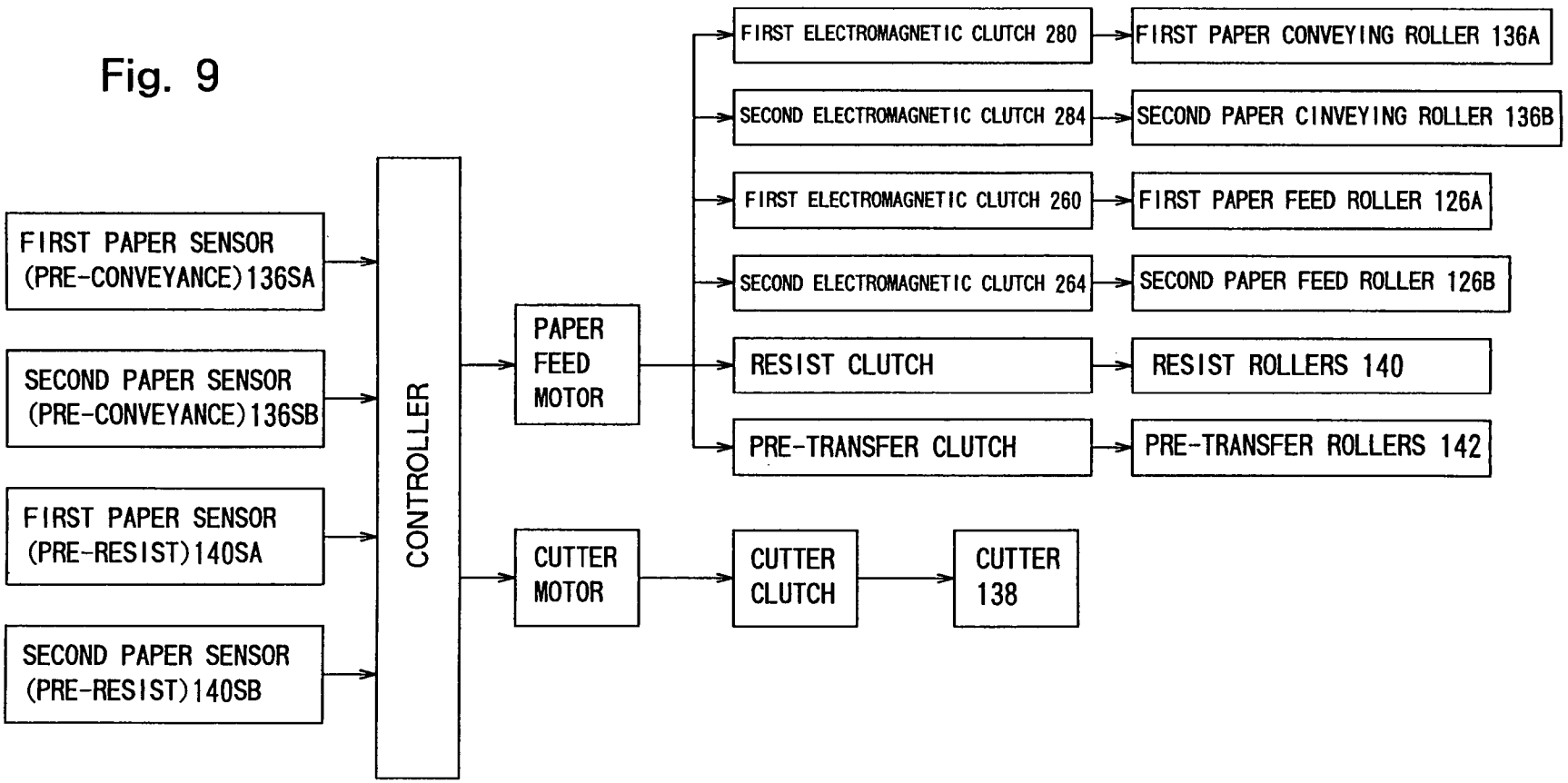
FIG. 9 is a view schematically illustrating a constitution related to controlling the conveyance and cutting of the papers delivered from the first and second rolled papers provided in the copier illustrated in FIG. 1.

Referring to FIG. 1 together with FIG. 9, a paper feed motor and a cutter motor which are electric motors (not shown) are arranged in the machine body 102. The cutter 138 is drivingly coupled to the cutter motor via an electromagnetic clutch that is not shown or, briefly speaking, via a power transmission mechanism including a cutter clutch. When the cutter clutch is turned on (connected), the cutter 138 operates to cut the paper. In a state where the cutter clutch is turned off (interrupted), the cutter 138 is brought to the home position, and the paper conveyed through the paper conveying passage 122 is not cut. The resist rollers 140 are drivingly coupled to the paper feed motor via an electromagnetic clutch that is not shown or, briefly speaking, via a power transmission mechanism including a resist clutch. When the resist clutch is turned on (connected), the resist rollers 140 are driven. In a state where the resist clutch is turned off (interrupted), the resist rollers 140 are halted.

The pre-transfer rollers 142 are drivingly coupled to the paper feed motor via an electromagnetic clutch that is not shown or, briefly speaking, via a power transmission mechanism including a pre-transfer clutch. When the pre-transfer clutch is turned on (connected), the pre-transfer rollers 142 are driven. In a state where the pre-transfer clutch is turned off (interrupted), the pre-transfer rollers 142 are halted.

On the downstream of the transfer device 116, there is provided a paper conveying passage 144 for conveying the paper on which the toner image has been transferred by the transfer device 116. On the downstream of the paper conveying passage 144, there are provided a fixing device 146 and discharge rollers 148. A front cover 150 is arranged on the front surface 102*a* (right end surface in FIG. 1) of the copier body 102. A pocket 152 is formed between the front cover 150 and the front surface 102*a* of the copier body 102 to accommodate the papers discharged by the discharge rollers 148. A document conveying passage 12 is formed on the upper end surface of the copier body 102, and a document placing table 154 is arranged at an upstream end of the document conveying passage 12 so as to extend from the copier body 102.

A closely contacted-type image sensor 104 reads the image of the document conveyed on the document conveying passage 12 by the document conveying device 10 in a manner as will be described later. The image read by the closely contacted-type image sensor 104 is transformed into a toner image through image-forming means 106, and is transferred onto a paper conveyed from any one of the rolled paper accommodation unit 200, 300 or 400. The toner image transferred onto the paper is fixed and recorded through the fixing device 146 and is discharged into the pocket 152 by the discharge rollers 148. The paper conveyed from any one of the rolled paper accommodation unit 200, 300 or 400 is cut into a predetermined length by the cutter at a suitable timing. The copying operation is executed by the copier 100 as roughly described above, and there is produced a copy recording the image of the document.

Referring to FIGS. 1 to 4, the rolled paper accommodation unit 200 mounted on the upper stage comprises an accommodation frame 202 mounted on the copier body 102 so as to be drawn out, first and second rolled paper units 204 and 206 arranged in the accommodation frame 202 on the same axis and in parallel with each other so as to be rotated independently from each other, and a drive mechanism 208 for driving the first and second rolled paper units 204 and 206. The accommodation frame 202 comprises a bottom wall 202*a* of nearly a rectangular shape, both side walls 202*b* erected from both side edges of the bottom wall 202*a*, and a front wall 202*c* erected from the front edge of the bottom wall 202*a*. Suitable rail means that is not shown is arranged between the accommodation frame 202 and the copier body 102. The accommodation frame 202 can be drawn forward out of the front surface 102*a* of the copier body 102 (direction of an arrow F in FIGS. 2 and 3) along the rail means in a state where the front cover 150 is opened and a cover (not shown) arranged on the front surface 102*a* of the copier body 102 is opened. The accommodation frame 202 can be further inserted in the reverse direction (direction of an arrow R in FIGS. 2 and 3) into the copier body 102 from the front surface 102*a* of the copier body 102. When inserted in the copier body 102, the accommodation frame 202 is detachably locked by a suitable locking means that is not shown so as to be mounted on a predetermined mounting position.

The first rolled paper unit 204 comprises a first roll body 210 and a first rolled paper 212 wound on the first roll body 210. The first roll body 210 disposed nearly at the central position in the direction of being drawn out from, and inserted in, the accommodation frame 202, comprises a cylindrical core member (not shown) on which the first rolled paper 212 is wound and roll flanges detachably and integrally attached to both ends of the cylindrical core member. Each roll flange has a first driven gear (external gear) 214, an engaging pawl member (not shown) extending in one axial direction from the one side of the first driven gear 214 in the axial direction, and a cylindrical portion 216 integrally formed on the other side of the first driven gear 214 on the other side thereof.

The outer diameter of the cylindrical portion 216 is greater than the outer diameter of the first driven gear 214. The roll flanges are detachably and integrally mounted on the cylindrical core member by inserting the engaging pawl members in the corresponding ends of the cylindrical core member. The first driven gear 214 and the cylindrical portion 216 of each roll flange are positioned on the outer side of the cylindrical core member in the axial direction. A pair of receiving plates 218 are arranged on the bottom wall 202*a* of the accommodation frame 202, and receiving rollers 218*a* are arranged on the receiving plates 218 so as to freely rotate. The first rolled paper unit 204 is supported so as to freely rotate as the cylindrical portions 216 of the roll flanges are supported by the receiving plates 218 via the receiving rollers 218*a*. Each receiving plate 218 is provided with a limiting portion (not shown) for limiting the cylindrical portion 216 of the corresponding roll flange from moving outward in the axial direction, whereby the first rolled paper unit 204 is limited from moving outward in the axial direction. The above basic constitution has been disclosed in, for example, Japanese Unexamined Patent Publication (Kokai) No. 2002-356253.

The second rolled paper unit 206 and its support structure are substantially the same as the first rolled paper unit 204 and its support structure. That is, the second rolled paper unit 206 disposed nearly at the central position in a direction in which the accommodation frame 202 is drawn out and inserted, has a second roll body 220 and a second rolled paper 222 wound on the second roll body 220. The second roll body 220 comprises a cylindrical core member (not shown) on which the second rolled paper 222 is wound, and roll flanges detachably and integrally attached to both ends of the cylindrical core member. Each roll flange has a second driven gear (external gear) 224, an engaging pawl member (not shown) extending in one axial direction from the one side of the second driven gear 224 in the axial direction, and a cylindrical portion 226 integrally formed on the other side of the second driven gear 224 on the other side thereof.

The outer diameter of the cylindrical portion 226 is greater than the outer diameter of the second driven gear 224. The roll flanges are detachably and integrally mounted on the cylindrical core member by inserting the engaging pawl members in the corresponding ends of the cylindrical core member. The second driven gear 224 and the cylindrical portion 226 of each roll flange are positioned on the outer side of the cylindrical core member in the axial direction. A pair of receiving plates 228 are arranged on the bottom wall 202*a* of the accommodation frame 202, and receiving rollers 228*a* are arranged on the receiving plates 228 so as to freely rotate. The second rolled paper unit 206 is supported so as to freely rotate as the cylindrical portions 226 of the roll flanges are supported by the receiving plates 228 via the receiving rollers 228*a*. Each receiving plate 228 is provided with a limiting portion (not shown) for limiting the cylindrical portion 226 of the corresponding roll flange from moving outward in the axial direction, whereby the second rolled paper unit 206 is limited from moving outward in the axial direction. The first rolled paper unit 204 and the second rolled paper unit 206 are supported by the corresponding receiving plates 218 and 228 on a common axis so as to freely rotate.

The drive mechanism 208 comprises first and second drive shafts 230 and 232 supported by the accommodation frame 202 so as to freely rotate. The first drive shaft 230 is supported by one side wall 202*b* and by one receiving plate 218 so as to freely rotate extending between the one side wall 202*b* of the accommodation frame 202 (right side wall 202*b* in FIG. 2) and the one receiving plate 218 of the first rolled paper unit 204 (left receiving plate 218 in FIG. 2). One end of the first drive shaft 230 extends outward from the one side wall 202*b*, and a first input gear 234 is disposed at one extended end thereof so as to freely rotate relative thereto. First electromagnetic clutch means or, in this embodiment, a first electromagnetic clutch 235 is disposed between the first input gear 234 and the first drive shaft 230. First drive gears 236 are integrally disposed near both ends of the first drive shaft 230, and are brought into mesh with the first driven gears 214 of the first rolled paper unit 204 via first intermediate gears 238. The first intermediate gears 238 are supported by the corresponding receiving plates 218 so as to freely rotate.

The second drive shaft 232 is supported by the side walls 202*b* so as to freely rotate extending between the side walls 202*b* of the accommodation frame 202. One end of the second drive shaft 232 extends outward from the one side wall 202*b*, and a second input gear 240 is disposed at one extended end thereof so as to freely rotate relative thereto. Second electromagnetic clutch means or, in this embodiment, a second electromagnetic clutch 242 is disposed between the second input gear 240 and the second drive shaft 232. Second drive gears 244 are integrally disposed near both ends of the second drive shaft 232, and are brought into mesh with the second driven gears 224 of the second rolled paper unit 206 via second intermediate gears 246. The second intermediate gears 246 are supported by the corresponding receiving plates 228 so as to freely rotate.

The axes of the rotary members arranged in the accommodation frame 202 are in parallel with each other. The first and second drive shafts 230 and 232 are arranged in the rear region in the accommodation frame 202 (front region in the direction of insertion relative to the copier body 102) maintaining a distance in the direction of insertion. The first and second intermediate gears 238 and 246 are so arranged as to be brought into mesh with the first and second driven gears 214 and 224 in the region in the accommodation frame 202 (front region in the direction of insertion relative to the copier body 102), the first drive shaft 230 is so arranged as to extend under the first intermediate gears 238, and the second drive shaft 232 is so arranged as to extend under the first and second intermediate gears 238 and 246. The first and second input gears 234 and 240 have substantially the same shape and the same size. The first and second drive gears 236 and 244 have substantially the same shape and the same size. The first and second intermediate gears 238 and 246 have substantially the same shape and the same size, and are arranged on a common axis. The first and second driven gears 214 and 224 have substantially the same shape and the same size.

A main input gear 248 is arranged in the accommodation frame 202 in mesh with the first and second input gears 234 and 240. The main input gear 248 is supported on the outer side of the side wall 202*b* so as to freely rotate. An output gear 250 is disposed in the machine body 102 being drivingly coupled, via a power transmission mechanism that is not shown, to an electric motor or, briefly speaking, a rolled paper motor which is a drive source that can be rotated forward and reverse. The main input gear 248, and the first and second intermediate gears 238, 246 have substantially the same shape and size, and are arranged on a common axis. When the accommodation frame 202 is mounted on the machine body 102, the main input gear 248 is brought into mesh with the output gear 250. As a result, the first and second rolled paper units 204 and 206 can be rotated independently from each other. That is, no driving force is transmitted to the first drive shaft 230 and/or to the second drive shaft 232 when the first electromagnetic clutch 235 and/or the second electromagnetic clutch 242 are turned off (interrupted) in a state where the rolled paper motor (not shown) is driven forward or reverse. Further, when the first electromagnetic clutch 235 and/or the second electromagnetic clutch 242 are turned on (connected), the driving force is transmitted, to the first drive shaft 230 and/or the second drive shaft 232. The first rolled paper 212 and/or the second rolled paper 222 are driven forward or reverse in the same direction.

The first rolled paper 212 of the first rolled paper unit 204 in the rolled paper accommodation unit 200 has a width (A2 which is 420 mm wide) smaller than a maximum width (A0 which is 841 mm wide) that can be used in the copier 100, and the second rolled paper 222 has a width (A3 which is 297 mm wide) smaller than the maximum width. The first rolled paper 212 is cut by the cutter 138 into A3 (direction of conveyance is in agreement with the direction of the width A3), and the second rolled paper 222 is cut by the cutter 138 into A4 (direction of conveyance is in agreement with the direction of width A4). The first rolled paper 212 and the second rolled paper 222 having smaller widths can be driven and halted independently from each other, and can be fed in parallel with each other in the direction of width.

Figure 5:
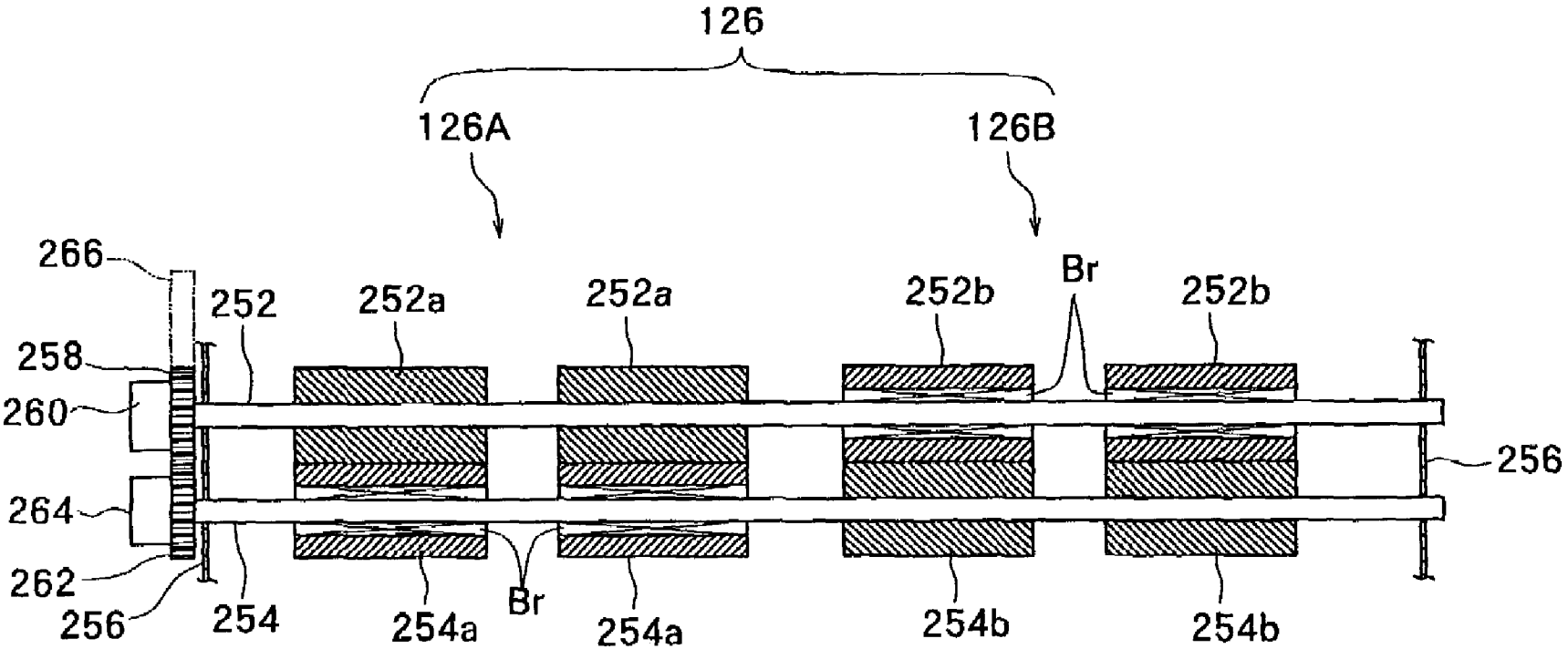
FIG. 5 is a sectional view viewing, from the upstream side, the paper feed rollers provided in the paper feed passage connected to the roll accommodation unit mounted on the upper stage of the copier illustrated in FIG. 1.

Referring to FIGS. 1 and 5, the paper feed rollers 126 disposed on the paper feed passage 124 has first and second drive shafts 252 and 254. The first and second drive shafts 252 and 254 are supported by the erected walls 256 so as to freely rotate extending in parallel between the erected walls 256 arranged maintaining a distance in the direction of width of the copier body 102 (front-and-back direction on the surface of the paper of FIG. 1). The ends on one side of the first and second drive shafts 252 and 254 are extending outward of the one erected wall 256. The first driven gear 258 is arranged at one end of the first drive shaft 252 so as to rotate relative thereto, and first electromagnetic clutch means or, in this embodiment, a first electromagnetic clutch 260 is disposed between the first driven gear 258 and the first drive shaft 252. The second driven gear 262 is arranged at one end of the second drive shaft 254 so as to rotate relative thereto, and second electromagnetic clutch means or, in this embodiment, a second electromagnetic clutch 264 is disposed between the second driven gear 262 and the second drive shaft 254. The first and second driven gears 258 and 262 are in mesh with each other. The first driven gear 258 is in mesh with the input gear 266 disposed in the copier body 102, and is drivingly coupled to the electric motor (not shown) which is the drive source or, briefly speaking, to the paper feed motor via the input gear 266 and the power transmission mechanism that is not shown.

In the region on one side in the axial direction with the center of the first and second drive shafts 252 and 254 in the axial direction as a boundary, there is arranged a first paper feed roller 126A. In the region on the other side thereof, there is arranged a second paper feed roller 126B. The first paper feed roller 126A comprises two drive rollers 252*a* integrally arranged on the first drive shaft 252 maintaining a distance in the axial direction, and two driven rollers 254*a* arranged on the second drive shaft 254 maintaining a distance in the axial direction so as to freely rotate relative thereto and being press-contacted to the corresponding drive rollers 252*a*. The driven rollers 254*a* are supported by the second drive shaft 254 via bearing members Br so as to freely rotate relative thereto. The second paper feed roller 126B comprises two drive rollers 254*b* integrally arranged on the second drive shaft 254 maintaining a distance in the axial direction, and two driven rollers 252*b* arranged on the first drive shaft 252 maintaining a distance in the axial direction so as to freely rotate relative thereto and being press-contacted to the corresponding drive rollers 254*b*. The driven rollers 252*b* are supported by the first drive shaft 252 via bearing members Br so as to freely rotate relative thereto.

Being constituted as described above, the first and second paper feed rollers 126A and 126B can be rotated independently from each other. That is, no driving force is transmitted to the first drive shaft 252 and/or to the second drive shaft 254 when the first electromagnetic clutch 260 and/or the second electromagnetic clutch 264 are turned off (interrupted) in a state where the rolled paper motor (not shown) is being rotated. Further, when the first electromagnetic clutch 260 and/or the second electromagnetic clutch 264 are turned on (connected), the driving force is transmitted to the first drive shaft 252 and/or the second drive shaft 254. When the driving force is transmitted to the first drive shaft 252, the first paper feed roller 126A only is driven. When the driving force is transmitted to the second drive shaft 254, the second paper feed roller 126B only is driven. When the driving force is transmitted to both the first and second drive shafts 252 and 254, both the first and second paper feed rollers 126A and 126B are driven.

Figure 6:
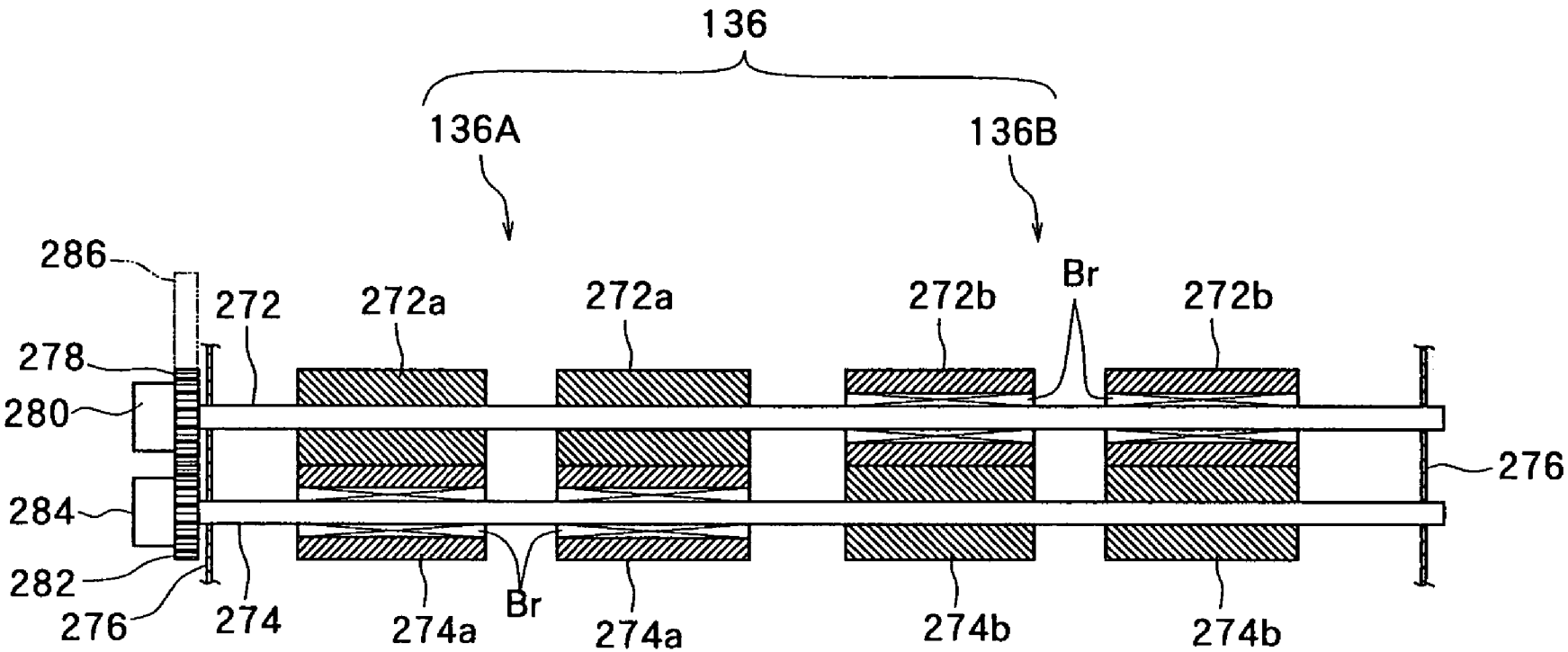
FIG. 6 is a sectional view viewing, from the upstream side, the paper conveying rollers provided in the paper conveying passage of the copier illustrated in FIG. 1.

Referring to FIGS. 1 and 6, the paper conveying roller 136 disposed on the paper conveying passage 122 is constituted substantially in the same manner as the above paper feed roller 126. The paper conveying roller 136 has first and second drive shafts 272 and 274. The first and second drive shafts 272 and 274 are supported by the erected walls 276 so as to freely rotate extending in parallel between the erected walls 276 arranged maintaining a distance in the direction of width of the copier body 102 (front-and-back direction on the surface of the paper of FIG. 1). The ends on one side of the first and second drive shafts 272 and 274 are extending outward of the one erected wall 276. The first driven gear 278 is arranged at one end of the first drive shaft 272 so as to rotate relative thereto, and first electromagnetic clutch means or, in this embodiment, a first electromagnetic clutch 280 is disposed between the first driven gear 278 and the first drive shaft 272. The second driven gear 282 is arranged at one end of the second drive shaft 274 so as to rotate relative thereto, and second electromagnetic clutch means or, in this embodiment, a second electromagnetic clutch 284 is disposed between the second driven gear 282 and the second drive shaft 274. The first and second driven gears 278 and 282 are in mesh with each other. The first driven gear 278 is in mesh with the input gear 286 disposed in the copier body 102, and is drivingly coupled to the paper feed motor (not shown) which is the drive source via the input gear 286 and the power transmission mechanism that is not shown.

In the region on one side in the axial direction with the center of the first and second drive shafts 272 and 274 in the axial direction as a boundary, there is arranged a first paper conveying roller 136A. In the region on the other side thereof, there is arranged a second paper conveying roller 136B. The first paper conveying roller 136A comprises two drive rollers 272*a* integrally arranged on the first drive shaft 272 maintaining a distance in the axial direction, and two driven rollers 274*a* arranged on the second drive shaft 274 maintaining a distance in the axial direction so as to freely rotate relative thereto and being press-contacted to the corresponding drive rollers 272*a*. The driven rollers 274*a* are supported by the second drive shaft 274 via bearing members Br so as to freely rotate relative thereto. The second paper conveying roller 136B comprises two drive rollers 274*b* integrally arranged on the second drive shaft 274 maintaining a distance in the axial direction, and two driven rollers 272*b* arranged on the first drive shaft 272 maintaining a distance in the axial direction so as to freely rotate relative thereto and being press-contacted to the corresponding drive rollers 274*b*. The driven rollers 272*b* are supported by the first drive shaft 272 via bearing members Br so as to freely rotate relative thereto.

Being constituted as described above, the first and second paper conveying rollers 136A and 136B can be rotated independently from each other. That is, no driving force is transmitted to the first drive shaft 272 and/or to the second drive shaft 274 when the first electromagnetic clutch 280 and/or the second electromagnetic clutch 284 are turned off (interrupted) in a state where the paper feed motor is being rotated. Further, when the first electromagnetic clutch 280 and/or the second electromagnetic clutch 284 are turned on (connected), the driving force is transmitted to the first drive shaft 272 and/or the second drive shaft 274. When the driving force is transmitted to the first drive shaft 272, the first paper conveying roller 136A only is driven. When the driving force is transmitted to the second drive shaft 274, the second paper conveying roller 136B only is driven. When the driving force is transmitted to both the first and second drive shafts 272 and 274, both the first and second paper conveying rollers 136A and 136B are driven.

The rolled paper accommodation unit 300 including the rolled paper 302 and the rolled paper accommodation unit 400 including the rolled paper 402 may be constituted in a customary manner, and are not described here in detail. Further, the paper feed rollers 130 disposed in the paper feed passage 128 and the paper feed rollers 134 disposed in the paper feed passage 132, too, may be constituted in a customary manner, and are not described here.

The rolled paper 302 in the rolled paper accommodation unit 300 has a width (A1 which is 594 mm wide) smaller than the maximum width of the paper that can be used in the copier 100. Further, the rolled paper 402 in the rolled paper accommodation unit 400 has the maximum width (A0 which is 841 mm wide).

Figure 7:
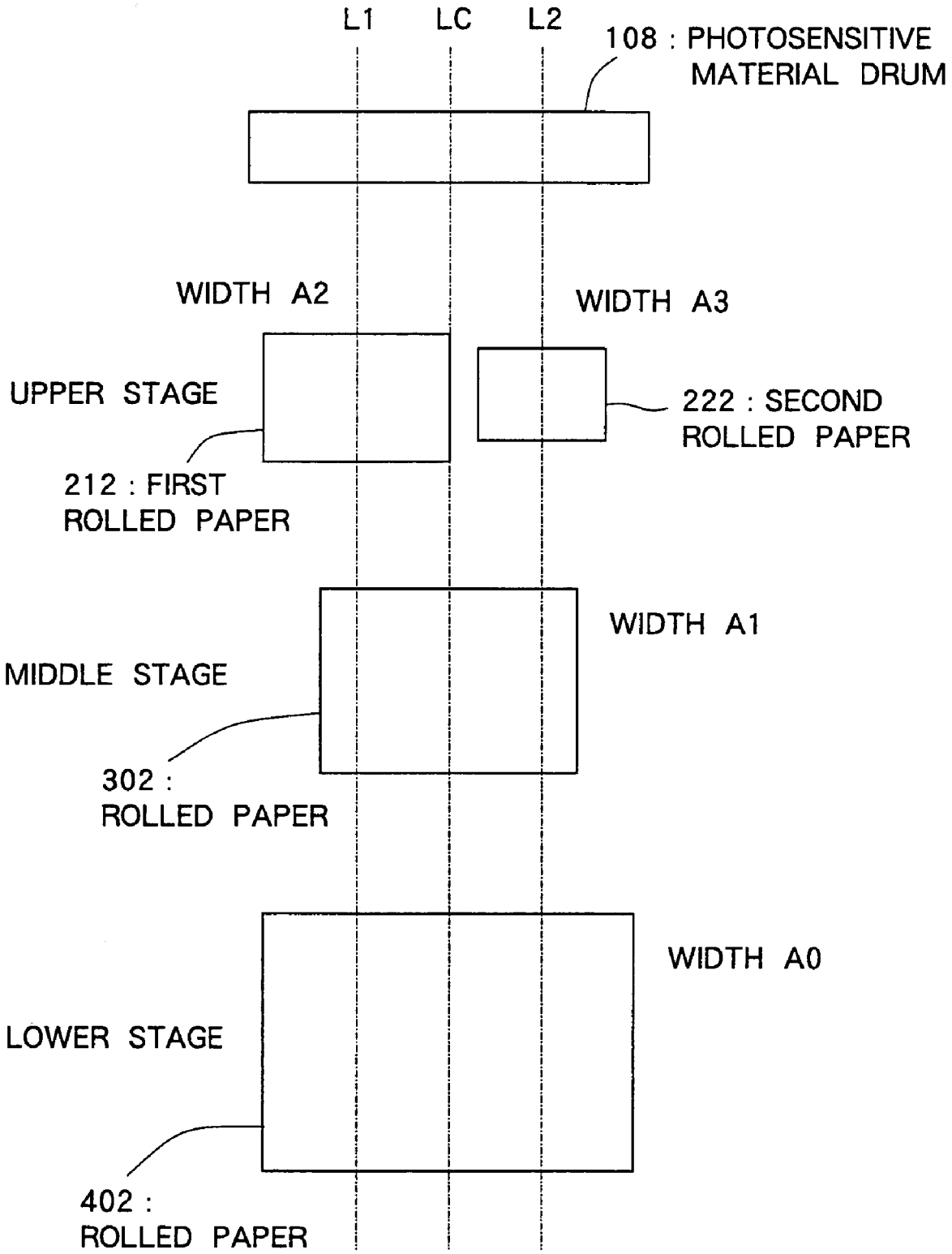
FIG. 7 is a diagram schematically illustrating a positional relationship between a conveyance reference position in the transfer region of the photosensitive material drum of the copier illustrated in FIG. 1 and conveyance reference positions of the rolled papers in the roll accommodation units mounted on the upper stage, on the middle stage and on the lower stage of the copier illustrated in FIG. 1.

In the copier 100 with reference to FIGS. 1 and 7, a plurality of conveyance reference positions are set in the transfer region in the direction of conveying width to meet the sizes in the direction of conveying width of the papers passing through the transfer region of the photosensitive material drum 108 (region facing the transfer device 116), and the rolled papers are installed in the rolled paper accommodation units correspondingly to the conveyance reference positions. In this embodiment, the conveyance reference positions comprise a first conveyance reference position which is a center line LC extending in a direction in which the paper is conveyed passing through a center of the transfer region in the direction of conveying width, a second conveyance reference position which is a straight line L1 extending in the direction in which the paper is conveyed passing through midway in the direction of conveying width of one region of the two regions divided by said center line LC in the direction of conveying width, and a third conveyance reference position which is a straight line L2 extending in the direction in which the paper is conveyed passing through midway in the direction of conveying width of the other region of the two regions divided by said center line LC in the direction of conveying width.

The rolled paper (A0 which is 841 mm wide) of the lower stage having a maximum width and the rolled paper 300 (A1 which is 594 mm wide) of the middle stage having a width smaller than that of the rolled paper 402 having the maximum width, are installed in the rolled paper accommodation units 400 and 300 in a manner that the central positions thereof in the direction of width are corresponded to the first conveyance reference position LC.

The first rolled paper 212 (A2 which is 420 mm wide) of the upper stage having a width smaller than that the maximum width of the rolled paper 402 is installed in the rolled paper accommodation unit 200 in a manner that the central position thereof in the direction of width is corresponded to the second conveyance reference position L1. Further, the second rolled paper 222 (A3 which is 297 mm wide) of the upper stage having a width smaller than that the maximum width of the rolled paper 402 is installed in the rolled paper accommodation unit 200 in a manner that the central position thereof in the direction of width is corresponded to the third conveyance reference position L2.

Referring to FIG. 9, the copier body 102 has a controller for controlling the conveyance and cutting of the papers delivered from the first and second rolled papers 212 and 222. The controller which may be the one that controls the copier 100 as a whole is constituted by a microcomputer which has a central processing unit (CPU) for effecting the arithmetic operation according to a control program, a ROM for storing the control program, a read-write RAM for storing the operated results, a timer, a counter, an input interface and an output interface. The input interface of the thus constituted controller receives detection signals detected by the first and second paper sensors (pre-conveyance) 136SA and 136SB, first and second paper sensors (pre-resist) 140SA and 140SB, as well as other switches and detectors. The output interface sends control signals to the paper feed motor (not shown), first electromagnetic clutches 260 and 280, second electromagnetic clutches 264 and 284, resist clutch that is not shown, pre-transfer clutch that is not shown, and to the cutter motor and the cutter clutch that are not shown.

Described below is the operation of the controller controlling the first and second rolled papers 212 and 222 in the rolled paper accommodation unit 200 mounted on the upper stage of the copier body 102. As described earlier, the first rolled paper 212 is cut by the cutter 138 into A3 (direction of conveyance is in agreement with the direction of width A3) and the second rolled paper 222 is cut by the cutter 138 into A4 (direction of conveyance in agreement with the direction of width A4).

Figure 10:
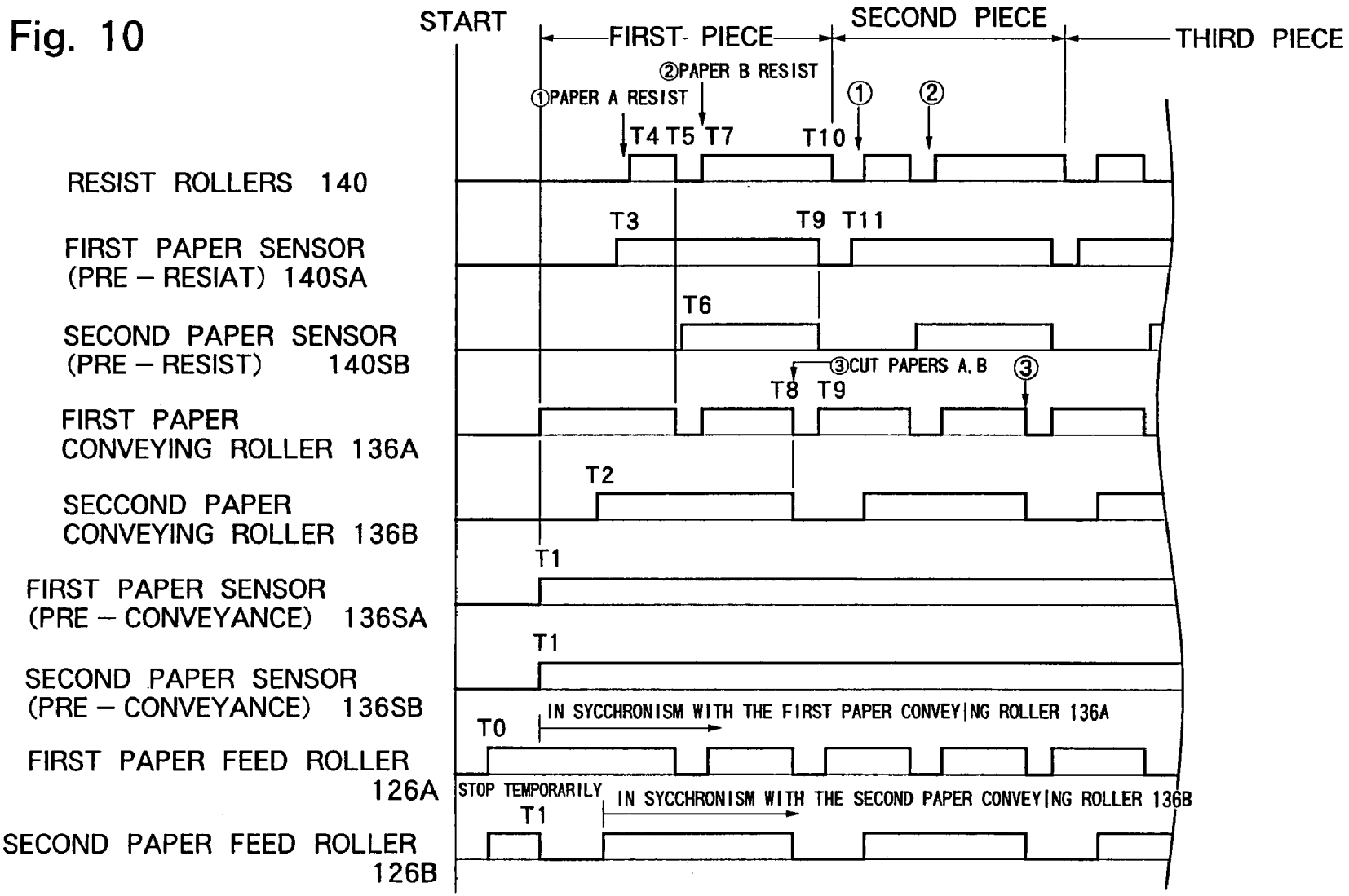
FIG. 10 is a timing chart illustrating control timings using the controller illustrated in FIG. 9.

Referring to FIGS. 1 and 8 to 10, the ends of the first and second rolled papers 212 and 222 remain at rest at substantially the same position in the direction of conveyance being nipped by the first and second paper feed rollers 126A and 126B. In FIG. 10, the "paper A" stands for the first rolled paper 212 and the "paper B" stands for the second rolled paper 222. In FIG. 10, further, the rising regions of the timing chart stand for turn-on and other regions stand for turn-off. At the start of copying, the controller drives the paper feed motor, and turns on the first and second electromagnetic clutches 260 and 264 of the first and second paper feed rollers 126A and 126B, to start driving the first and second paper feed rollers 126A and 126B (timing position denoted by T0 in FIG. 10). The papers are delivered (drawn) from the first and second rolled papers 212 and 222. The controller further drives the cutter motor.

As the ends of the papers drawn from the first and second rolled papers 212 and 222 arrive at the first and second paper sensors (pre-conveyance) 136SA and 136SB, the arrival is detected by the first and second paper sensors (pre-conveyance) 136SA and 136SB, and the detection signals are sent to the controller. Upon receipt of the detection signals, the controller turns off the second electromagnetic clutch 264 of the second paper feed roller 126B, stops driving the second paper feed roller 126B temporarily, stops delivering the second rolled paper 222 and, at the same time temporarily, turns on the first electromagnetic clutch 280 of the first paper conveying roller 136A to start driving the first paper conveying roller 136A (timing position denoted by T1 in FIG. 10). The first rolled paper 212 only is delivered.

After the passage of a predetermined period of time from having temporarily stopped driving the second paper feed roller 126B, the controller turns on the second electromagnetic clutch 264 of the second paper feed roller 126B to drive again the second paper feed roller 126B and, at the same time, turns on the second electromagnetic clutch 284 of the second paper conveying roller 136B to start driving the second paper conveying roller 136B (timing position denoted by T2 in FIG. 10). The end of the first rolled paper 212 is conveyed leading ahead of the end of the second rolled paper 222 by a predetermined length. As the end of the first rolled paper 212 that is leading arrives at the first paper sensor (pre-resist) 140SA, the arrival is detected by the first paper sensor (pre-resist) 140SA (timing position denoted by T3 in FIG. 10). The detection signal is sent to the controller. After the passage of a predetermine period of time from when the detection signal is received, the controller turns the resist clutch on in a state where the end of the first rolled paper 212 is in contact with the nipping portion of the resist roller 140 and is deflected, thereby to drive the resist roller 140*s* (timing position denoted by T4 in FIG. 10). The first rolled paper 212 is conveyed by the resist rollers 140. Though not diagramed, the controller turns the pre-transfer clutch on simultaneously with the turn on of the resist clutch to drive the pre-transfer rollers 142.

After the passage of a predetermined period of time from when the resist rollers 140 are driven, the first electromagnetic clutch 280 of the first paper conveying roller 136A is turned off to stop driving the first paper conveying roller 136A and, at the same time, the first electromagnetic clutch 260 of the first paper feed roller 126A is turned off to stop driving the first paper feed roller 126A (timing position denoted by T5 in FIG. 10). Delivery of the first rolled paper 212 is halted.

As the end of the second rolled paper 222 arrives at the second paper sensor (pre-resist) 140SB, the arrival is detected by the second paper sensor (pre-resist) 140SB. The detection signal is sent to the controller. After the passage of a predetermine period of time from when the detection signal is received, the controller turns on the first electromagnetic clutch 280 of the first paper conveying roller 136A to drive again the first paper conveying roller 136A and, further, turns on the first electromagnetic clutch 260 of the first paper feed roller 126A to drive again the first paper feed roller 126A (timing position denoted by T6 in FIG. 10). At the same time, the controller further turns on the resist clutch in a state where the end of the second rolled paper 222 is in contact with the nipping portion of the resist rollers 140 and is deflected thereby to drive the resist rollers 140 (timing position denoted by T7 in FIG. 10). The first and second rolled papers 212 and 222 are conveyed by the resist rollers 140 in a state where the end of the first rolled paper 212 is leading ahead of the end of the second rolled paper 222 by a predetermined length (difference between the width A3 and the width A4).

After the passage of a predetermined period of time from when the first paper conveying roller 136A, first paper feed roller 126A and resist roller 140 are driven again, the controller turns off the first electromagnetic clutch 280 of the first paper conveying roller 136A, turns off the second electromagnetic clutch 284 of the second paper conveying roller 136B, turns off the first electromagnetic clutch 260 of the first paper feed roller 126A and turns off the second electromagnetic clutch 264 of the second paper feed roller 126B to stop driving the first and second paper conveying rollers 136A, 136B and the first and second paper feed rollers 126A and 126B (timing position denoted by T8 in FIG. 10). The controller at the same time turns the cutter clutch on to operate the cutter 138. The first and second rolled papers 212 and 222 are simultaneously cut into sizes A3 and A4, respectively. Though the resist rollers 140 are being driven during this period, the deflection that has been formed absorbs the tension in the back-and-forth direction.

The papers cut by the cutter 138 into sizes A3 and A4 are conveyed by the resist rollers 140. As the rear ends of the papers of the sizes A3 and A4 pass through the first and second paper sensors 140SA and 140SB, respectively, the passages thereof are detected by the first and second paper sensors 140SA and 140SB. The detection signals are sent to the controller. Upon receipt of the detection signals, the controller turns on the first electromagnetic clutch 280 of the first paper conveying roller 136A to drive the first paper conveying roller 136A, and turns on the first electromagnetic clutch 260 of the first paper feed roller 126A to drive the first paper feed roller 126A (timing position denoted by T9 in FIG. 10). The first paper conveying roller 136A and the first paper feed roller 126A start conveying the first and second rolled papers 212 and 222 of which the ends are at the position of the cutter 138.

After the passage of a predetermined period of time from when the rear ends of the papers of the sizes A3 and A4 have passed through the first and second paper sensors 140SA and 140SB, the controller turns the resist clutch off to stop driving the resist roller 140 (timing position denoted by T10 in FIG. 10). This timing is when the rear ends of the papers of the sizes A3 and A4 are separated away from the nipping portion of the resist rollers 140 forward in the direction of conveyance. The first papers of the sizes A3 and A4 cut by the cutter 138 are conveyed by the pre-transfer rollers 142 toward the photosensitive material drum 108. While passing through the transfer region of the photosensitive material drum 108, the paper of the size A3 cut from the first rolled paper 212 has its center in the direction of conveying width in alignment with the conveyance reference position L1 of the photosensitive material drum 108. Further, while passing through the transfer region of the photosensitive material drum 108, the paper of the size A4 cut from the second rolled paper 222 has its center in the direction of conveying width in alignment with the conveyance reference position L2 of the photosensitive material drum 108. While passing through the transfer region of the photosensitive material drum 108, the paper of the size A3 cut from the first rolled paper 212 and the paper of the size A4 cut from the second rolled paper 222 are not overlapped one upon the other.

As for the operation for conveying and cutting the second and subsequent papers, the front ends of the second and subsequent papers from where the conveyance is to start are simply at the position of the cutter 138. The basic operation after the first paper conveying roller 136A and the first paper feed roller 126A have started conveying the first and second rolled papers 212 and 222, is substantially the same as that for the first papers, and is obvious from FIG. 10 and is not described here again in detail. After the end of copying on the first and second rolled papers 212 and 222, the controller turns the rolled paper motor reverse, and turns on the first and second electromagnetic clutches 235 and 242 in the roll accommodation unit 200 of the upper stage to reversely rotate the first and second rolled papers 212 and 222. At a moment when the front ends of the first and second rolled papers 212 and 222 have passed through the paper sensors disposed on the paper feed passage 124, the controller turns off the first and second electromagnetic clutches 235 and 242 to stop reversely rotating the first and second rolled papers 212 and 222. The front ends of the first and second rolled papers 212 and 222 are in a state of being nipped by the first and second paper feed rollers 126A and 126B.

The rolled paper 302 in the roll accommodation unit 300 of the middle stage and the rolled paper 402 in the roll accommodation unit 400 of the lower stage may be conveyed and cut in a customary manner, and are not described here. The positions for installing the rolled papers 302 and 402 are so specified that, when passing through the transfer region of the photosensitive material drum 108, the centers in the direction of width of the rolled paper 302 in the roll accommodation unit 300 of the middle stage and of the rolled paper 402 in the roll accommodation unit 400 of the lower stage, are in alignment with the first conveyance reference position LC.

In the above copier 100, there are selected a plurality of conveyance reference positions in the transfer region in the direction of conveying width or, in this embodiment, there are selected three conveyance reference positions LC, L1 and L2 to meet the sizes of the papers passing through the transfer region in the direction of conveying width, and the rolled papers 212, 222, 302 and 402 are installed in the rolled paper accommodation units 200, 300 and 400 so as to be corresponded to the conveyance reference positions. As a result, the copier 100 make it possible to copy or print the papers of various sizes, to evenly utilize the transfer region of the photosensitive material drum 108 nearly over the entire width thereof to maintain stable image-forming characteristics and to lengthen the life of the photosensitive material drum 108.

In this embodiment, the conveyance reference positions comprise a first conveyance reference position which is a center line LC extending in a direction in which the paper is conveyed passing through a center of the transfer region in the direction of conveying width, a second conveyance reference position which is a straight line L1 extending in the direction in which the paper is conveyed passing through midway in the direction of conveying width of one region of the two regions divided by said center line LC in the direction of conveying width, and a third conveyance reference position which is a straight line L2 extending in the direction in which the paper is conveyed passing through midway in the direction of conveying width of the other region of the two regions divided by said center line LC in the direction of conveying width. The rolled paper 402 having the maximum width (width A0) is installed in the rolled paper accommodation unit 400 of the lower stage in a manner that the central position thereof in the direction of width is corresponded to the first conveyance reference position. Further, the first and second rolled papers 212 and 222 which are the two rolled papers having widths (A2 and A4) smaller than the maximum width are installed in the rolled paper accommodation unit 200 of the upper stage in a manner that the central positions thereof in the direction of width are corresponded to the second and third conveyance reference positions L1 and L2, respectively. Further, the rolled paper 302 having a width (A1) smaller than the maximum width is installed in the rolled paper accommodation unit 300 of the middle stage in a manner that the central position thereof in the direction of width is corresponded to the first conveyance reference position LC. As a result, the rolled paper 402 having the maximum width (A0) and the rolled paper 302 having the width (A1) smaller than the above maximum width, pass through the transfer region with their centers in the direction of width in alignment with the above center line LC. The first and second rolled papers 212 and 222 having widths (A2 and A4) smaller than the maximum width pass through the transfer region with their centers in the direction of width in alignment with the straight lines L1 and L2. Therefore, it is made possible to copy or print the papers of various sizes, to evenly utilize the transfer region of the photosensitive material drum 108 nearly over the entire width thereof to practicably, easily and reliably maintain stable image-forming characteristics and to lengthen the life of the photosensitive material drum 108. The straight lines L1 and L2 are arranged midway in one region and midway in the other region. Here, the midway stands for a center and a central region in one region and in the other region, and comprises ranges of some width from the centers.

The first and second rolled papers 212 and 222 having widths (A2 and A4) smaller than the maximum width are arranged on the same axis and in parallel with each other, contributing to realizing the machine body 102 in a compact size, decreasing the frequency for exchanging the rolled papers, facilitating the exchanging operation, and reducing the burden of work.

The first and second rolled papers 212 and 222 having widths (A2 and A4) smaller than the maximum width can be fed in parallel with each other. Therefore, the papers of a plurality of sizes can be continuously copied or printed simultaneously to enhance the productivity and efficiency. It is allowable to feed only either the first rolled paper 212 or the second rolled paper 222, as a matter of course. Besides, the papers discharged into the pocket 152 can be sorted depending upon the sizes, which is practically convenient.

The first and second rolled papers 212 and 222 having widths (A2 and A4) smaller than the maximum width can be fed independently from each other. It is therefore allowed to freely determine the timings for conveying the first and second rolled papers 212 and 222, and to arbitrarily control the conveying timings, which is very convenient to use.

The positions for installing the first and second rolled papers 212 and 222 having widths (A2 and A4) smaller than the maximum width are so specified that the first and second rolled papers 212 and 222 that are delivered will not be overlapped one upon the other when they pass through the transfer region. It is therefore allowed to feed the papers in parallel and simultaneously. It is further allowed to improve the productivity and efficiency. Further, the papers discharged into the pocket 152 can be sorted depending upon the sizes.

According to the present invention, only one cutter 138 is necessary for cutting the papers in a direction at right angles with the direction of conveyance, and no cutter is necessary for cutting the papers in the direction of conveyance. Besides, the papers of various sizes A0 to A4 can be copied or printed without wasting the papers.

In the above embodiment, the first rolled paper 212 is cut by the cutter 138 into A3 (the direction of conveyance is in agreement with the direction of width A3), and the second rolled paper 222 is cut by the cutter 138 into A4 (the direction of conveyance is in agreement with the direction of width A4) According to another embodiment, the first rolled paper 212 can be cut by the cutter 138 into A2 (the direction of conveyance is in agreement with the longitudinal direction of A2), and the second rolled paper 222 can be cut by the cutter 138 into A3 (the direction of conveyance is in agreement with the longitudinal direction of A3). That is, basically, each rolled paper can be cut into two kinds of sizes.

Figure 11:
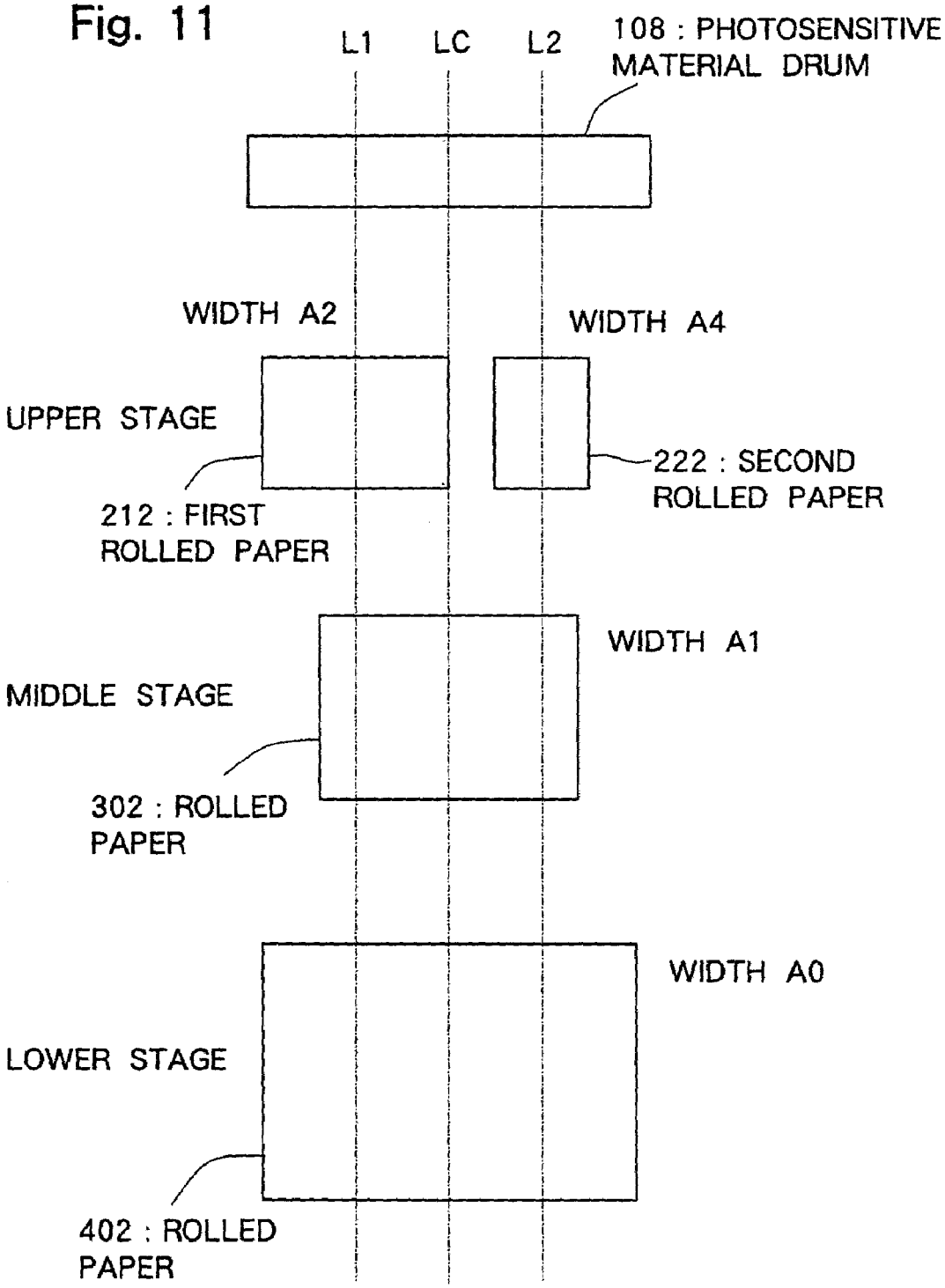
FIG. 11 is a diagram of arrangement illustrating another embodiment of the invention arranging a second rolled paper having another size as the second rolled paper that is provided in the copier illustrated in FIG. 1, and corresponds to FIG. 7.

FIG. 11 illustrates another embodiment of the present invention arranging the second rolled paper 222 having the other size (width A4) as the second rolled paper 222. In regard to other constitutions, this embodiment is substantially the same as the above embodiment. In this embodiment, the first rolled paper 212 is cut by the cutter into A3 (the direction of conveyance is in agreement with the direction of width A3) and the second rolled paper 222 is cut by the cutter 138 into A4 (the direction of conveyance is in agreement with the longitudinal direction of A4). After having been cut, the papers have an equal length in the direction of conveyance and can, hence, be fed in parallel at the same timing, i.e., can be conveyed, stopped and cut at the same timings. As compared to the above embodiment, therefore, the control operation is easy and the papers can be fed in parallel at an increased speed. According to the above-mentioned embodiment, the A4-size papers are processed at a speed slower than that of the embodiment illustrated in FIG. 11. Here, when the first rolled paper 212 is cut by the cutter 138 into A2 (the direction of conveyance is in agreement with the longitudinal direction of A2) and when the second rolled paper 222 is cut by the cutter 138 into A4 (the direction of conveyance is in agreement with the longitudinal direction of A4), the papers after having been cut possess different lengths in the direction of conveyance. Therefore, the first and second rolled papers 212 and 222 are conveyed, stopped and cut at timings which are basically the same as those of the above-mentioned embodiment.

Figure 12:
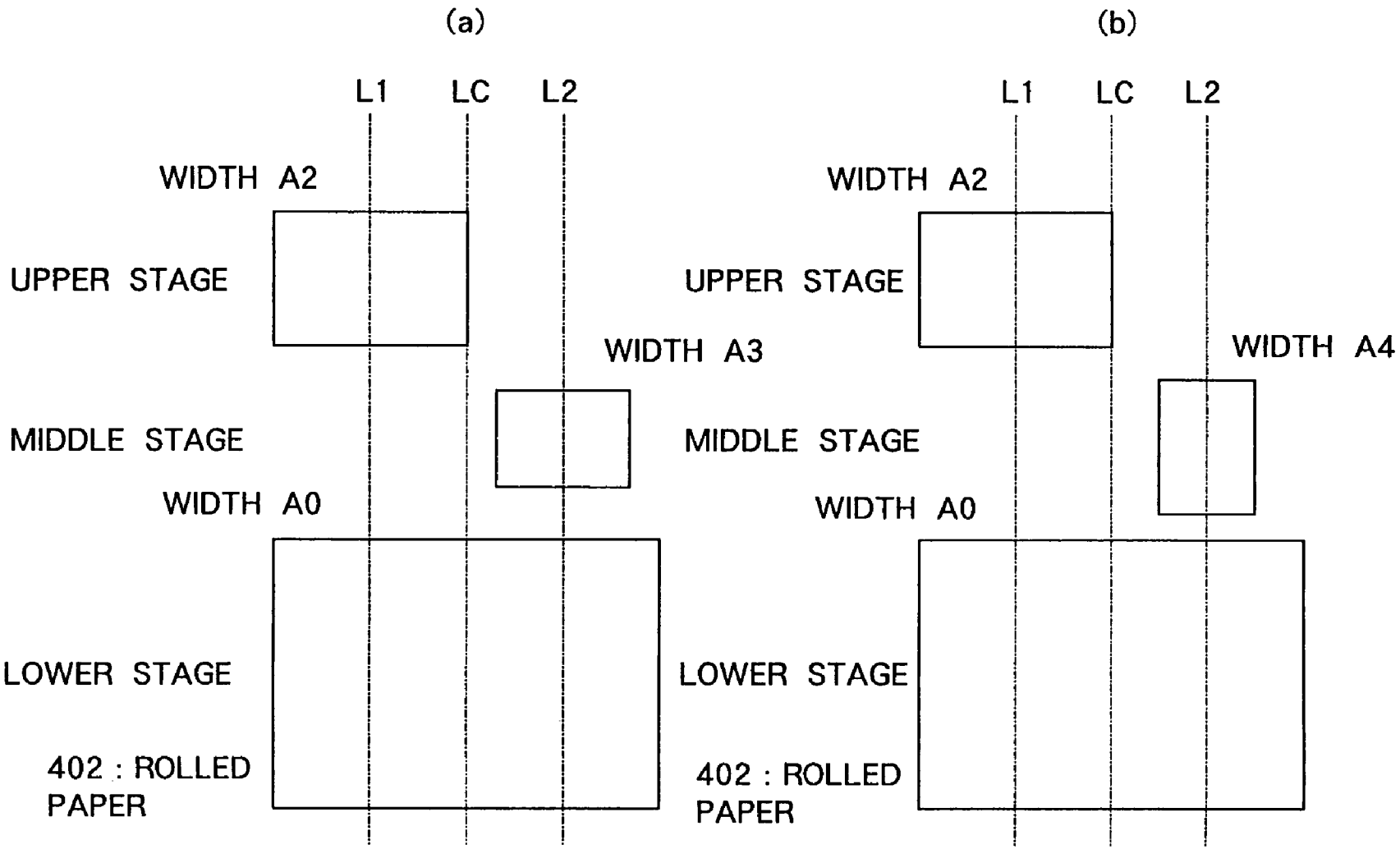
FIG. 12(*a*) is a diagram of arrangement illustrating a further embodiment of the arrangement of rolled papers, and nearly corresponds to FIG. 7, and FIG. 12(*b*) is a diagram of arrangement illustrating a still further embodiment arranging a rolled paper of another size as the rolled paper of the middle stage in the arrangement of the rolled papers illustrated in FIG. 12(*a*), and corresponds to FIGS. 12(*a*)

FIG. 12(*a*) illustrates an embodiment in which the second rolled paper 222 (width A3) only is arranged in the middle stage in the copier 100 described with reference to FIGS. 1 to 10. That is, the first rolled paper 212 and the second rolled paper 222 having widths smaller than the maximum width of the rolled paper 402, are arranged on different axes. The first rolled paper 212 and the second rolled paper 222 are fed independently from each other. The rolled paper accommodation unit of the upper stage accommodating the first rolled paper 212 and the rolled paper accommodation unit accommodating the second rolled paper 222, may be constituted in substantially the known manner. The rolled paper accommodation unit 402 of the lower stage is constituted in the same manner as that of the above-mentioned embodiment. FIG. 12(*b*) illustrates an embodiment in which the second rolled paper 222 arranged in the middle stage has the width A4 instead of the width A3. In other respects, the constitution is the same as the constitution illustrated in FIG. 12(*a*).

In the embodiments illustrated in FIGS. 12(*a*) and 12(*b*), the conveyance reference positions comprise a first conveyance reference position which is a center line LC extending in a direction in which the paper is conveyed passing through a center of the transfer region in the direction of conveying width, a second conveyance reference position which is a center line L1 extending in the direction in which the paper is conveyed passing through a center in the direction of conveying width of one region of the two regions divided by said center line LC in the direction of conveying width, and a third conveyance reference position which is a center line L2 extending in the direction in which the paper is conveyed passing through a center in the direction of conveying width of the other region of the two regions divided by said center line LC in the direction of conveying width. The rolled paper having the maximum width (A0) is installed in the rolled paper accommodation unit of the lower stage in a manner that the central position thereof in the direction of width is corresponded to the first conveyance reference position LC, and the two rolled papers having smaller widths (A2 and A3 or A4) are installed in the rolled paper accommodation units of the upper stage and of the middle stage in a manner that the central positions thereof in the direction of width are corresponded to the second and third conveyance reference positions L1 and L2, respectively. The above constitution can be realized by utilizing the basic constitution of a conventional apparatus.

Figure 13:
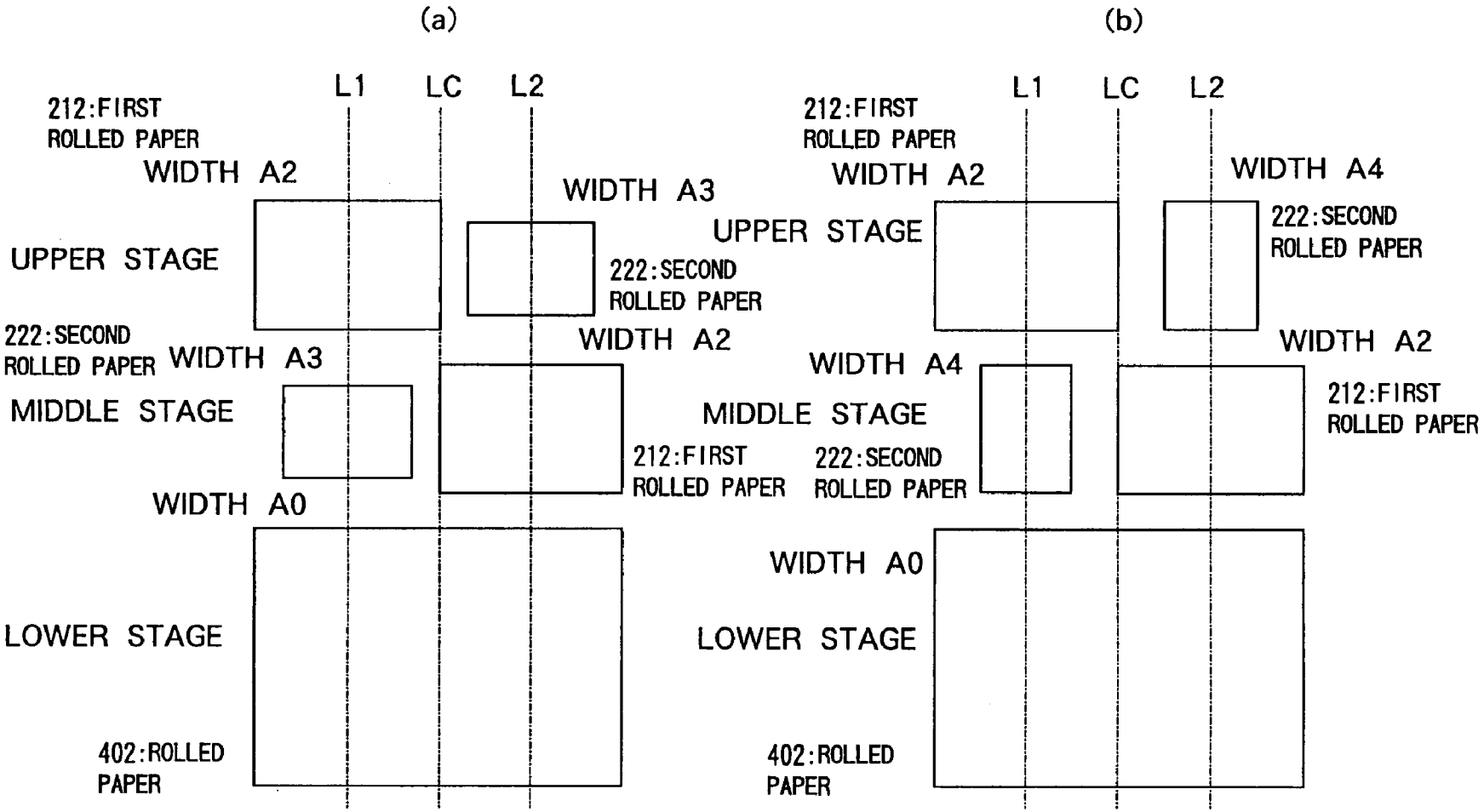
FIG. 13(*a*) is a diagram of arrangement illustrating a yet further embodiment of the arrangement of rolled papers, and nearly corresponds to FIG. 7, and FIG. 13(*b*) is a diagram of arrangement illustrating a further embodiment arranging rolled papers of other sizes as the rolled paper of the upper stage and the middle stage in the arrangement of the rolled papers illustrated in FIG. 13(*a*), and corresponds to FIGS. 13(*a*).

FIG. 13(*a*) illustrates an embodiment in which the rolled paper accommodation unit accommodating the first and second rolled papers 212 and 222 in a reversed manner in the direction of width, is arranged in the middle stage of the copier 100 described with reference to FIGS. 1 to 10. In other respects, the constitution is substantially the same as that of the copier 100 described with reference to FIGS. 1 to 10. FIG. 13(*b*) illustrates a further embodiment of the invention arranging the second rolled paper 222 having the other size (A4) as the second rolled paper 222 in the embodiment of FIG. 13(*a*). This constitution enables the papers of the same size to be fed in parallel to further improve the productivity.

The other embodiments illustrated in FIGS. 11, 12(*a*), 12(*b*), 13(*a*) and 13(*b*) share characteristic and basic constitution with the copier 100 described with reference to FIGS. 1 to 10, and the common basic constitution exhibits substantially the same action and effect.

The invention claimed is:

1. An image-forming machine comprising a plurality of rolled paper accommodation units in which rolled papers are installed, a conveying means for conveying papers delivered from the rolled papers along a paper conveying passage, a cutting means for cutting the papers that are conveyed, and an image-forming means for transferring the image while the papers being conveyed pass through a transfer region, wherein a plurality of conveyance reference positions are set in a direction of conveying width in the transfer region so as to be corresponded to the sizes of the papers passing through the transfer region in the direction of the conveying width, and the rolled papers are installed in the rolled paper accommodation units correspondingly to the conveyance reference positions, wherein said conveyance reference positions of the plurality of rolled papers having widths smaller than the rolled paper having the maximum width are set at a plurality of places, and among the rolled papers having smaller widths, the two rolled papers are arranged on the same axis and in parallel with each other; further wherein the conveyance reference positions comprise a first conveyance reference position which is a center line extending in a direction in which the paper is conveyed passing through a center of the transfer region in the direction of conveying width, a second conveyance reference position which is a straight line extending in the direction in which the paper is conveyed passing through midway in the direction of conveying width of one region of the two regions divided by said center line in the direction of conveying width, and a third conveyance reference position which is a straight line extending in the direction in which the paper is conveyed passing through midway in the direction of conveying width of the other region of the two regions divided by said center line in the direction of conveying width; and the rolled paper having the maximum width is installed in a rolled paper accommodation unit in a manner that the central position thereof in the direction of width is corresponded to the first conveyance reference position, and the two rolled papers having smaller widths are installed in a rolled paper accommodation unit in a manner that the central positions thereof in the direction of width are corresponded to the second and third conveyance reference positions, respectively.

2. An image-forming machine according to claim 1, wherein the two rolled papers having smaller widths can be fed in parallel with each other.

3. An image-forming machine according to claim 1, wherein the two rolled papers having smaller widths can be fed independently from each other.

4. An image-forming machine according to claim 1, wherein the rolled paper accommodation unit comprises an accommodation frame that is so mounted as can be drawn out from the machine body, first and second rolled paper units arranged in the accommodation frame on the same axis and in parallel with each other so as to rotate independently from each other, and a drive mechanism for driving the first and second rolled paper units; and when the accommodation frame is mounted on the machine body, the drive mechanism is drivingly coupled to a drive source which is arranged in the machine body to rotate forward and reverse, and the first and second rolled paper units are rotated independently from each other.

5. An image-forming machine according to claim 4, wherein the first rolled paper unit comprises a first roll body that is supported in the accommodation frame so as to freely rotate and has first driven gears attached to both ends thereof integrally therewith in the axial direction, and the first rolled paper wound on the first roll body; the second rolled paper unit comprises a second roll body that is supported in the accommodation frame so as to freely rotate and has second driven gears attached to both ends thereof integrally therewith in the axial direction, and the second rolled paper wound on the second roll body; the drive mechanism has a first drive shaft and a second drive shaft supported in the accommodation frame so as to freely rotate; the first drive shaft has a first input gear arranged thereon so as to freely rotate relative thereto, and has first drive gears arranged integrally therewith so as to be in mesh with the first driven gears via first intermediate gears; the second drive shaft has a second input gear arranged thereon so as to freely rotate relative thereto, and has second drive gears arranged integrally therewith so as to be in mesh with the second driven gears via second intermediate gears; a first electromagnetic clutch means is arranged between the first input gear and the first drive shaft; a second electromagnetic clutch means is arranged between the second input gear and the second drive shaft; a main input gear in mesh with the first and second input gears is supported in the accommodation frame so as to freely rotate; an output gear drivingly coupled to the drive source is arranged in the machine body; and the main input gear is brought into mesh with the output gear when the accommodation frame is mounted on the machine body.

6. An image-forming machine comprising a plurality of rolled paper accommodation units in which rolled papers are installed, a conveying means for conveying papers delivered from the rolled papers along a paper conveying passage, a cutting means for cutting the papers that are conveyed, and an image-forming means for transferring the image while the papers being conveyed pass through a transfer region, wherein a plurality of conveyance reference positions are set in a direction of conveying width in the transfer region so as to be corresponded to the sizes of the papers passing through the transfer region in the direction of the conveying width, and the rolled papers are installed in the rolled paper accommodation units correspondingly to the conveyance reference positions; wherein said conveyance reference positions of the plurality of rolled papers having widths smaller than the rolled paper having the maximum width are set at a plurality of places, and among the rolled papers having smaller widths, the two rolled papers are arranged on the axes different from each other; wherein the two rolled papers having smaller widths can be fed independently from each other; further wherein the conveyance reference positions comprise a first conveyance reference position which is a center line extending in a direction in which the paper is conveyed passing through a center of the transfer region in the direction of conveying width, a second conveyance reference position which is a straight line extending in the direction in which the paper is conveyed passing through midway in the direction of conveying width of one region of the two regions divided by said center line in the direction of conveying width, and a third conveyance reference position which is a straight line extending in the direction in which the paper is conveyed passing through midway in the direction of conveying width of the other region of the two regions divided by said center line in the direction of conveying width; and the rolled paper having the maximum width is installed in the rolled paper accommodation unit in a manner that the central position thereof in the direction of width is corresponded to the first conveyance reference position, and the two rolled papers having smaller widths are installed in the rolled paper accommodation unit in a manner that the central positions thereof in the direction of width are corresponded to the second and third conveyance reference positions, respectively.

7. An image-forming machine comprising a plurality of rolled paper accommodation units in which rolled papers are installed, a conveying means for conveying the papers delivered from rolled papers along a paper conveying passage, a cutting means for cutting the papers that are conveyed, and an image-forming means for transferring the image while the papers being conveyed pass through a transfer region, wherein a plurality of conveyance reference positions are set in a direction of conveying width in the transfer region so as to be corresponded to the sizes of the papers passing through the transfer region in the direction of the conveying width, and the rolled papers are installed in the rolled paper accommodation units correspondingly to the conveyance reference positions; wherein said conveyance reference positions of the plurality of rolled papers having widths smaller than the rolled paper having the maximum width, are set at a plurality of places, and among the rolled papers having smaller widths, the two rolled papers are arranged on the axes different from each other; wherein the two rolled papers having smaller widths can be fed independently from each other; further wherein the conveyance reference positions comprise a first conveyance reference position which is a center line extending in a direction in which the paper is conveyed passing through a center of the transfer region in the direction of conveying width, a second conveyance reference position which is a center line extending in the direction in which the paper is conveyed passing through a center in the direction of conveying width of one region of the two regions divided by said center line in the direction of conveying width, and a third conveyance reference position which is a center line extending in the direction in which the paper is conveyed passing through a center in the direction of conveying width of the other region of the two regions divided by said center line in the direction of conveying width; and the rolled paper having the maximum width is installed in the rolled paper accommodation unit in a manner that the central position thereof in the direction of width is corresponded to the first conveyance reference position, and the two rolled papers having smaller widths are installed in the rolled paper accommodation unit in a manner that the central positions thereof in the direction of width are corresponded to the second and third conveyance reference positions, respectively.

8. An image-forming machine according to claim 1, wherein the first rolled paper unit comprises a first roll body that is supported in the accommodation frame so as to freely rotate and has first driven gears attached to both ends thereof integrally therewith in the axial direction, and the first rolled paper wound on the first roll body; the second rolled paper unit comprises a second roll body that is supported in the accommodation frame so as to freely rotate and has second driven gears attached to both ends thereof integrally therewith in the axial direction, and the second rolled paper wound on the second roll body; a drive mechanism has a first drive shaft and a second drive shaft supported in the accommodation frame so as to freely rotate; the first drive shaft has a first input gear arranged thereon so as to freely rotate relative thereto, and has first drive gears arranged integrally therewith so as to be in mesh with the first driven gears via first intermediate gears; the second drive shaft has a second input gear arranged thereon so as to freely rotate relative thereto, and has second drive gears arranged integrally therewith so as to be in mesh with the second driven gears via second intermediate gears; a first electromagnetic clutch means is arranged between the first input gear and the first drive shaft; a second electromagnetic clutch means is arranged between the second input gear and the second drive shaft; a main input gear in mesh with the first and second input gears is supported in the accommodation frame so as to freely rotate; an output gear drivingly coupled to a drive source is arranged in the machine body; and the main input gear is brought into mesh with the output gear when the accommodation frame is mounted on the machine body.

* * * * *